US005802796A

United States Patent [19]

McClinton et al.

[11] Patent Number: 5,802,796

[45] Date of Patent: Sep. 8, 1998

[54] CURVILINEAR MASONRY BUILDING UNIT HAVING A GLAZE COMPOSITION AND USES THEREOF

[76] Inventors: John L. McClinton, 7432 Hickory La., Hanover, Md. 21076; Russell P. Rich, 902 W. Northern Pkwy., Baltimore, Md. 21210

[21] Appl. No.: 417,156

[22] Filed: Apr. 4, 1995

[51] Int. Cl.[6] ..... E04C 1/00

[52] U.S. Cl. ..... 52/596; 52/591.1; 52/608; 52/609; 52/612; 52/245

[58] Field of Search ..... 52/596, 591.1, 52/608, 609, 612, 245

[56] References Cited

U.S. PATENT DOCUMENTS

| | | | |
|---|---|---|---|
| 2,751,775 | 6/1956 | Sergovic | 52/596 X |
| 2,890,492 | 6/1959 | Smith . | |
| 3,237,910 | 3/1966 | Lavedas . | |
| 3,621,086 | 11/1971 | Guide . | |
| 3,945,747 | 3/1976 | Cruz | 52/596 X |
| 4,041,670 | 8/1977 | Kaplan . | |
| 4,154,423 | 5/1979 | Crock . | |
| 4,572,699 | 2/1986 | Rinninger . | |
| 4,698,949 | 10/1987 | Dietrich | 52/596 X |
| 4,769,961 | 9/1988 | Gillet . | |
| 4,821,479 | 4/1989 | Lucak . | |
| 4,877,656 | 10/1989 | Baskin | 52/596 X |
| 5,201,602 | 4/1993 | Repasky | 52/608 X |
| 5,221,223 | 6/1993 | Kao | 52/608 X |
| 5,285,611 | 2/1994 | McClinton | 52/596 X |
| 5,372,676 | 12/1994 | Lowe . | |
| 5,384,997 | 1/1995 | McClinton | 52/596 |
| 5,410,848 | 5/1995 | McClinton et al. | 52/596 X |
| 5,428,934 | 7/1995 | Tomek | 52/608 |
| 5,465,544 | 11/1995 | Ghahary | 52/596 X |

*Primary Examiner*—Wynn E. Wood
*Attorney, Agent, or Firm*—Pollock, Vande Sande & Priddy

[57] ABSTRACT

A building unit including a base unit including a non-curvilinear front face, two side faces, a back face, a top face, and a bottom face. A glaze portion is applied to the front face of the base unit. The glaze portion includes a front face having a curvilinear portion including at least a portion of an inside corner, a back face adjacent the front face of the base unit, two side faces, a top face, and a bottom face.

17 Claims, 24 Drawing Sheets

CURVILINEAR MASONRY BUILDING UNIT HAVING A GLAZE COMPOSITION AND USES THEREOF

RELATED APPLICATIONS

This application is related to co-pending U.S. patent Ser. No. 08/202,254, filed Feb. 24, 1994, and PCT application PCT/US95/02937, filed Feb. 24, 1995, both for "Curvilinear Masonry Building Unit, Method Of Applying A Glaze Composition Thereto, A Wall Corner, A Wall Corner Composite, A Column Composite Or Portion Thereof, And A Mold For Applying Glaze Composition To A Curvilinear Masonry Building Unit," the entire disclosures of both of which are hereby incorporated by reference.

FIELD OF THE INVENTION

The present invention relates to masonry building units having a face including an inside corner wherein the inside corner is formed from a glaze composition. The invention also relates to methods for providing inside corners formed from a glaze composition applied to a masonry building unit. The invention additionally relates to forming inside corners and inside corner composites in a wall construction containing at least one curvilinear masonry building unit of the invention. The invention further relates to molds for applying a glaze composition to provide a curvilinear face to masonry building units and a method for applying a glaze composition to such units.

BACKGROUND OF THE INVENTION

Filled polymeric materials have been known to provide decorative and protective surfaces to walls. For instance, it has been known to coat masonry units filled with polyesters and to form walls therefrom. The basic patent on the use of polyester as coating for masonry units is U.S. Pat. No. 2,751,775 to Sergovic and assigned to the assignee of the present invention.

Over the years, a number of improvements in the coating compositions for the masonry building units have been developed. For instance, U.S. Pat. No. 3,328,231 to Sergovic and assigned to the assignee of the present invention, discloses a glazed masonry building block of a cured composition of unsaturated polyester resin and sand in which the sand comprises at least 50% by weight of the coating composition. The unsaturated polyester is derived from a reaction between a dicarboxylic acid such as phthalic, maleic, fumaric, adipic, pimelic, suberic, itaconic, citraconic, succinic acids, and/or an anhydride thereof, and a polyhydric alcohol such as ethylene glycol, diethylene glycol, and propylene glycol. Also present in such compositions is an unsaturated monomer, such as methyl methacrylate, styrene, diallyl phthalate, t-butyl styrene, and alphamethyl styrene. Furthermore, U.S. Pat. No. 4,031,289 to Sergovic discloses coated masonry building blocks, articles and compositions therefore that employ resinous pigments and chemicals in combination with various resinous compositions to provide stain resistance when subjected to high moisture conditions and/or staining media. The entire disclosures of the above-mentioned U.S. Pat. Nos. 2,751,775; 3,328,231 and 4,031,289 are hereby incorporated herein by reference.

Constructing walls with glazed masonry building units presents particular problems with respect to the formation of inside corners of the wall structure. Known attempts to construct inside corners typically involve simply forming a corner using two intersecting masonry building units having faces including at least one planar surface. The corner, which may be formed from planar surfaces on the faces of one more blocks, may be a sharp 90° corner formed by the intersection of the exterior surfaces of two walls.

Co-pending U.S. patent application Ser. No. 08/202,254, filed Feb. 25, 1994, discloses curvilinear masonry building units that have a front face and/or a back face that includes a curvilinear portion. Application Ser. No. 08/202,254 suggests masonry building units that have at least one face that include a curvilinear surface. The curvilinear surface, although it may be glazed, is formed from the same material and is continuous with the remaining portions of the unit.

SUMMARY OF THE INVENTION

The present invention overcomes many of the problems in the prior art by providing masonry building units that include a curvilinear portion formed from a glaze composition. Forming such masonry building units and applying a glaze composition to such units may suffer from problems similar to those discussed in co-pending U.S. patent application Ser. No. 08/202,254, and U.S. Pat. No. 4,329,822, the entire disclosure of which is also hereby incorporated by reference. For example, masonry building units that include a curvilinear portion may suffer not only from the problems of cracks in the blocks but also the glaze. Furthermore, due to the differences in the thermal characteristics of the block and the glaze, problems may arise from the thermal expansion of masonry building units that include a curvilinear portion. The above-described problems may result in a very limited use for masonry building units that include a curvilinear portion.

The present invention solves the above problems, among others, and also provides a system that may utilize a composite construction of two curvilinear masonry units for constructing a wall corner. It is not known in the art to turn corners using masonry building units that include a curvilinear portion such as those of the present invention. A corner or corner composite constructed according to the present invention exhibits a superior looking wall and corner along with a higher level of acceptance at the job site and a reduced percentage of rejected materials at the manufacturing site.

When two walls intersect at right angles, the present invention may provide for eliminating a mortar joint at the extreme corner and permits the mortar joint to be moved to a point down the wall away from the extreme corner of the wall. Such a wall corner is more architecturally aesthetic than the traditional mortar falling directly at the extreme intersection of the two walls. Additionally, the present invention makes it possible to achieve the benefits of a mitre joint on an integral wall construction without the problems of having any mortar joint visible at the extreme corner of the construction, and without using a connecting unit as shown, for example, by U.S. Pat. No. 4,329,822 as a spacer to turn the corner. The present invention further provides for having integrated self-supporting main wall units.

In alternative embodiments, the present invention is concerned with providing curvilinear masonry units that include a curvilinear portion for use in constructing a corner that is structurally reinforced.

In accordance with the above objects and advantages, among others, one aspect of the present invention is concerned with a masonry unit that includes a curvilinear portion. The unit includes a front face, a back face, a top face, a bottom face, and two side faces. Each of these faces may include more than one portion, such as a back or side face comprising two planar portions as described below. At least the front face includes a curvilinear surface formed from a glaze composition. The curvilinear portion is generally opposite to the back face.

The reference to the location of the faces of the units such as front, back, top, bottom and side is used herein to denote the relationship of the various faces to each other but is not intended to denote the orientation of the unit in a particular building construction. In addition, the various angles of the finished intersecting faces can be sharply defined as illustrated in various figures or can be somewhat rounded. When rounded, it is typically rounded with a radius of about one-half inch to about three inches, and more typically about one inch.

A further aspect of the present invention is concerned with a wall corner comprising at least one masonry building unit that includes a curvilinear portion. The masonry building unit includes a front face, back face, top face, bottom, and two side faces. The front face and/or the back face is intended to be exposed and comprises a curvilinear portion forming at least a portion of a corner that is opposite to the back face. The curvilinear portion is formed from a glaze composition and intersects the side faces, top face, and bottom face.

In an alternative embodiment of the present invention, the present invention provides a composite providing a chimney or portion thereof that employs at least two masonry building units that include a curvilinear surface of the types disclosed hereinabove. The masonry building units are oriented such that the side of one masonry building unit is opposed to the opposite side face of a second masonry building unit.

An additional aspect of the present invention is concerned with a method of applying a glaze composition to a masonry building unit to form a curvilinear portion on the masonry building unit. The masonry building unit is substantially as described above. The glaze composition is applied according to a method comprising the step of applying glaze composition to a mold comprising at least a curvilinear segment. The curvilinear segment of the mold has a curvature substantially similar to the desired shape of the curvilinear portion to be formed on a face of the masonry building unit.

According to the method, a face of the masonry building unit is contacted with the surface of the glaze composition and the mold. The masonry building unit is simultaneously vibrated and forced into the glaze composition. The glaze is then cured and the resulting glazed masonry building unit is then removed from the mold.

The invention also provides a mold for applying a glaze composition to masonry building units. The mold includes at least a curvilinear portion.

Still other objects and advantages of the present invention will become readily apparent those skilled in this art from the following detailed description, wherein it is shown and described only the preferred embodiments of the invention, simply by way of illustration of the best mode contemplated of carrying out the invention. As will be realized, the invention is capable of other and different embodiments, and it's several details are capable of modifications in various obvious respects, without departing from the invention. Accordingly, the drawings and description are to be regarded as illustrative in nature and not as restrictive.

DETAILED DESCRIPTION OF BEST AND VARIOUS MODES FOR CARRYING OUT THE INVENTION

Figure 1:
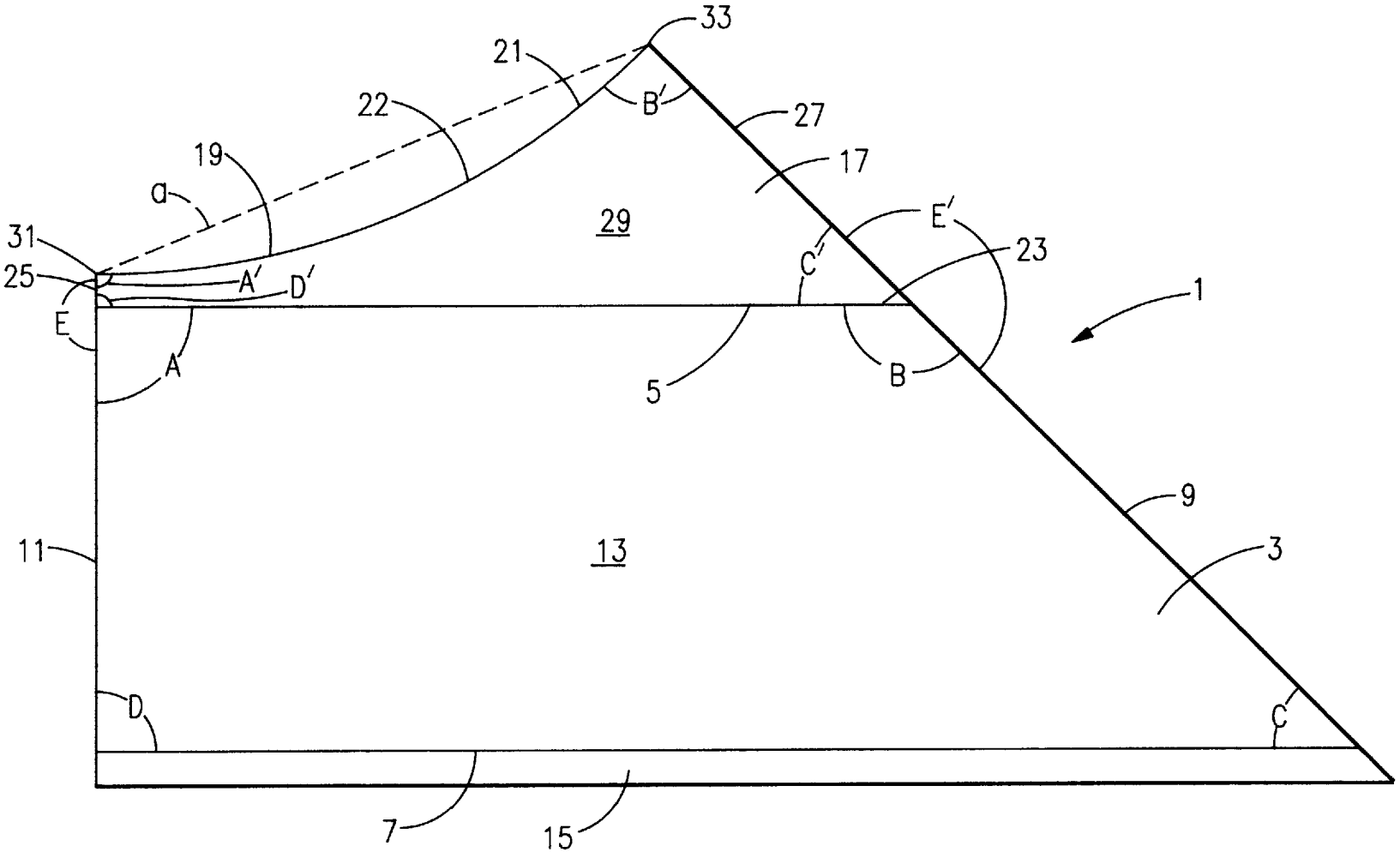
FIG. 1 represents a top elevational view of one embodiment according to the present invention of a masonry building unit that includes an inside corner curvilinear portion formed of a glaze composition.

In order to facilitate an understanding of the present invention, reference is made to the figures. In particular, FIG. 1 is a top elevational view of a masonry building unit 1 including an inside corner formed from a glaze composition pursuant to the present invention. The unit 1 includes a base portion 3 and a glaze portion 17.

In the present invention, the front face of the unit, including the base portion and the glaze portion is generally used to refer to a face including a curvilinear portion forming an inside corner. The back face is generally used to refer to a face including one or more planar portions generally opposite the front face. This inside corner curvilinear portion forms at least a portion of an inside corner of a wall.

The base portion preferably includes a front face 5, a back face 7, two side faces 9 and 11, a top face 13, and a bottom face (not shown). All of the surfaces of these faces of the unit 1 may be planar. Alternatively, the surface of the faces may have another contour. For example, the surface of the faces may include multiple planar portions, curvilinear portions, cut-out portions and/or protuberance portions. In a finished masonry building unit according to the invention, the side and/or back faces may be formed, at least in part, by the glaze portion of the unit.

The base portion 3 of the units 1 may also have another shape. For example in the embodiment shown in FIG. 3, the base portion includes a front face 5 and two side faces 9 and 11. However, in this embodiment, the back face 7 includes two portions 7*a* and 7*b*.

The angles that the various faces of a base unit intersect each other vary, depending upon the application and the embodiment involved. For example, the side face 11 intersects the front face 5 at an angle A. In the embodiment of the base unit 3 shown in FIGS. 1, 2, and 5–8 the angle A is about a 90°. On the other hand, in the embodiment shown in FIG. 3, angle A is about 135°. Alternatively, in the embodiment shown in FIG. 4, the angle A is about 120°. In other embodiments, the angle A between the front face 5 and side face 11 of the base unit may be different, depending upon the embodiment and the application.

Figure 2:
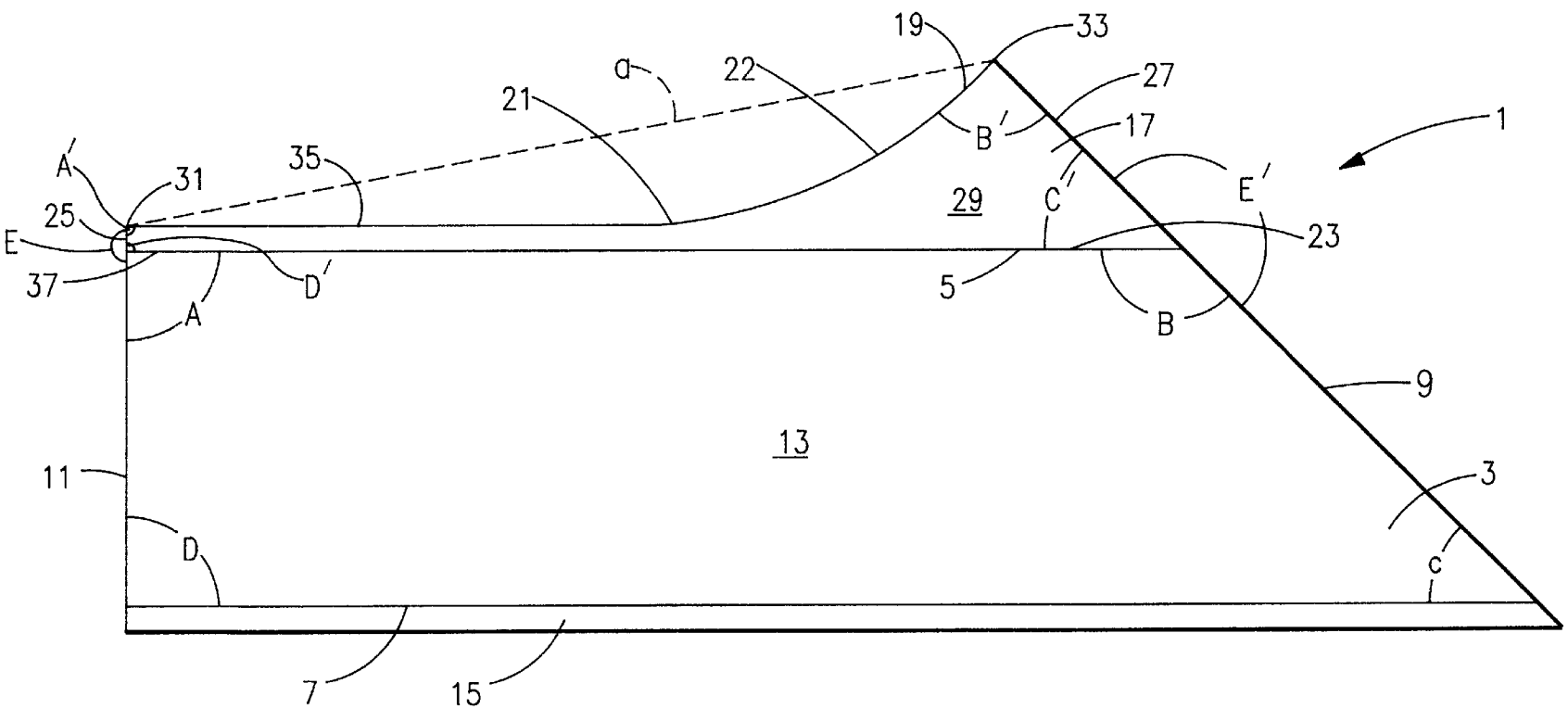
FIG. 2 represents a top elevational view of another embodiment of a masonry building unit that includes an inside corner curvilinear portion formed of a glaze composition.
Figure 3:
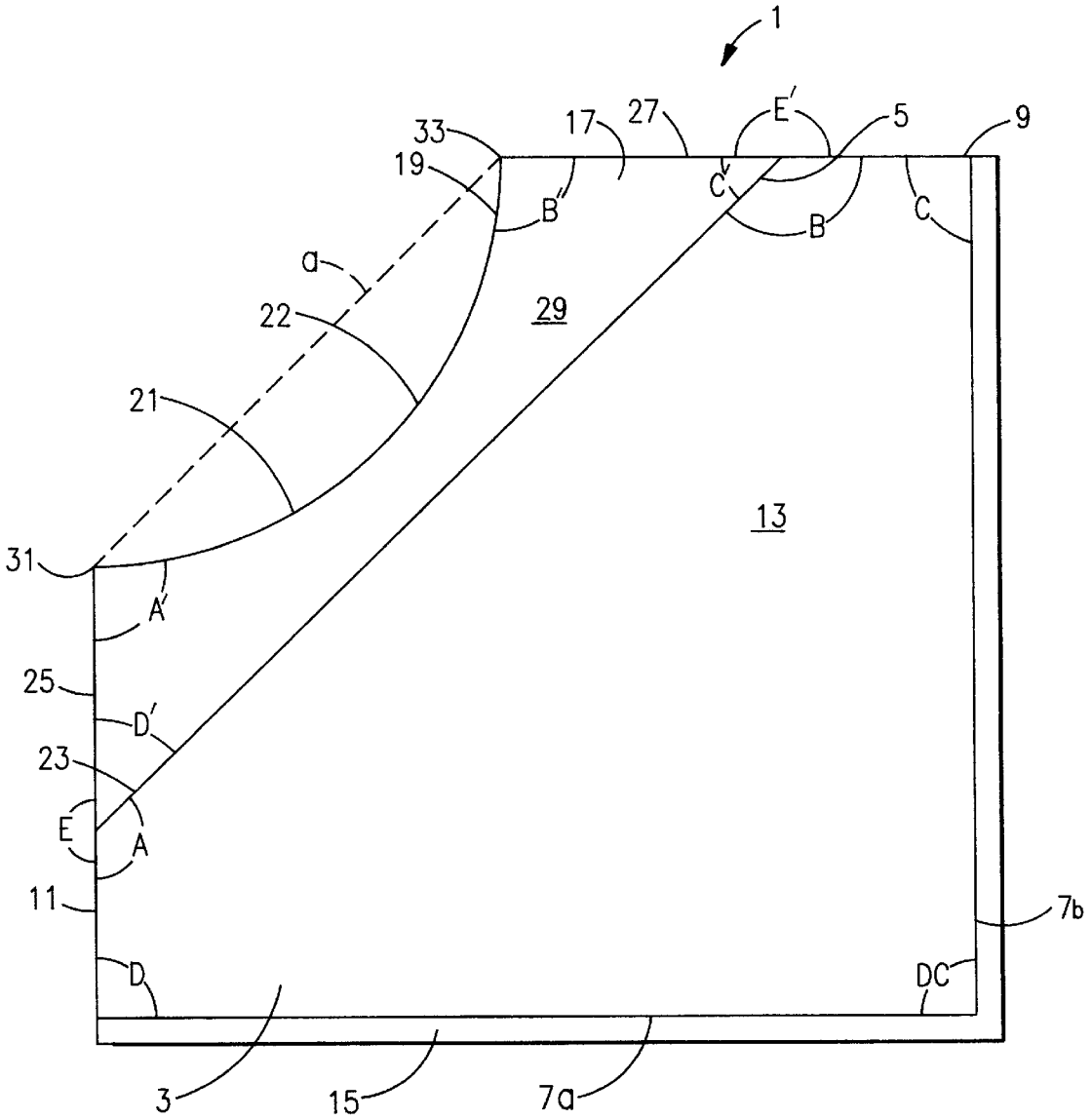
FIG. 3 represents a top elevational view of further embodiment of a masonry building unit that includes an inside corner curvilinear portion formed of a glaze composition.

The angle B that the other side face 9 intersects the front face 5 of the base unit may be about 135° in the embodiments shown in FIGS. 1–3. In the embodiments shown in FIGS. 5–8 angle B is about 90°. As with the side face 11, the angle between the front face 5 and side face 9 of the base unit may vary, depending upon the embodiment and the application.

As with the angle between the side faces or a portion thereof and the front face, the angle between the side faces or portions thereof and the back face or portions thereof may vary, depending upon the embodiment and the application. For example, the angle D between the side face 11 and the back face 7 in the embodiments shown in FIGS. 1 and 2 is about 90°. Similarly, the angle D between the side face 11 and the back face portion 7*a* in the embodiment shown in FIG. 3 is also about 90°. On the other hand, the angle D between the side face 9 and the back face 7 in the embodiments shown in FIGS. 1 and 2 is about 45°. However, the embodiments shown in FIGS. 3 and 4, the angle C between the side face 9 and the back face portion 7*b* is about 90°.

Regardless of its form, the base portion 3 of the unit 1 may be made from materials commonly employed to produce masonry blocks such as cinders, slag, cement, haydite, clay, or the like. The base portion may be formed in a desired shape. Alternatively, the base unit may be formed by cutting a previously formed unit. For example, the side face 9 in the embodiments shown in FIGS. 1 and 2 may be formed by cutting off a portion of one end of a rectangular unit. Alternatively, the base unit of the embodiment shown in FIG. 5 may be a typical stretcher unit shown in FIG. 9.

A glaze composition is applied to the front face 5 to form the inside corner curvilinear portion of the unit 1. The back face 7 of the base portion 3 of the curvilinear masonry unit 1 may also include a glaze composition 15. Examples of suitable glaze compositions are based upon the unsaturated polyester resin compositions disclosed in U.S. Pat. Nos. 2,751,775; 3,328,231; 3,632,725; 4,031,289; and 4,329,822; the entire disclosures of which are hereby incorporated by reference and relied upon. Whether a glaze is applied to the back face depends, at least in part, upon whether the back face it is intended that the back face be exposed to the environment in which the unit is employed in a building application. Alternatively, the decision as to whether to apply a glaze composition to the back face if the unit is used in an interior application may depend upon whether the back face is intended to be exposed to view.

An inside corner curvilinear portion 17 formed from a glaze composition is applied to the front face 5 of the base portion 3 of the curvilinear masonry unit 1. The glaze portion 17 includes a front face 19 having a surface 21 including a curvilinear portion 22 forming at least a portion of an inside corner. In this context, an inside corner is used to define a corner in which an arc from one point on a surface of the curve to another point on the surface of the curve is less than 180°.

The glaze portion 17 also includes a back face 23 abutting the front face 5 of the base portion 3. Side faces 25 and 27 of the glaze portion 17 may or may not be co-planar with the side faces 9 and 11 of the base portion 3 of the masonry building unit 1. The glaze portion further comprises a top face 29 and a bottom face (not shown). The top face 29 and bottom face (not shown) of the unit 1 preferably are co-planar with the top face 13 and bottom face (not shown) of the base portion 3.

With the exception of the curvilinear front face 19, the surface of the side faces 25 and 27, back face 23, top face 29, and bottom face of the glaze portion 17 may all be planar. The side faces, back face, top face, and bottom face may include more than one planar portion and may also have other contours.

The angles that the various faces intersect each other varies. For example, the side face 25 of the glaze portion intersects a line tangent to the front face 19 at an angle A'. In the embodiment shown in FIG. 1, the angle A' is about 90° similarly to radius of a circle having a circumference matching the curvature of the curvilinear portion of the front face of the unit 1. In the embodiment shown in FIG. 3, the angle A' is about a similar size.

Figure 7:
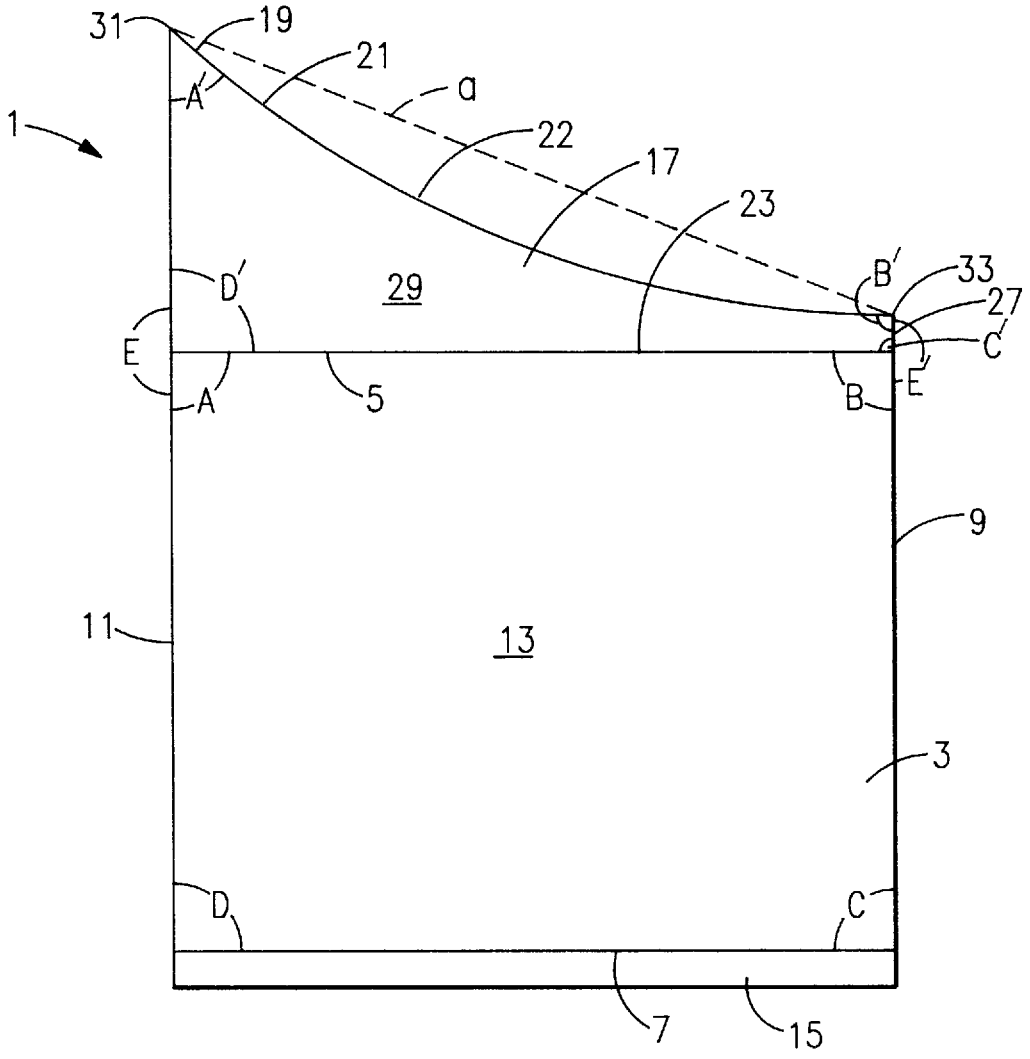
FIG. 7 represents a top elevational view of further additional embodiment of a masonry building unit that includes an inside corner curvilinear portion formed of a glaze composition.

In other embodiments, the angle A' may vary. For example, the angle A' between the side face 25 and a line tangent to the front face 19 in the embodiment shown in FIG. 7 is less than 90°. In any embodiment, the angle A' formed by the intersection between the front face and the side face 25 of the glaze portion of the completed unit may vary, depending, at least in part, on the desired angle of a wall incorporating the unit, the number of units desired to turn the corner in a wall, whether the front face 19 of the glaze portion 17 includes a planar portion and the angle B' of the side wall 27 of the glaze portion with the front face of an adjacent unit.

The angle B' between the side face 27 of the glaze portion 17 and the front face 19 or a line tangent to the front face of the glaze portion at the intersection point between the side face 27 and the front face may also vary, depending upon the embodiment and the application. In the embodiments shown in FIGS. 1–3 and 5–8, the angle B' is about 90°. As stated above, the angle B' may vary. The factors involved in determining the size of angle B' may include the factors affecting the size of angle A'.

Figure 4:
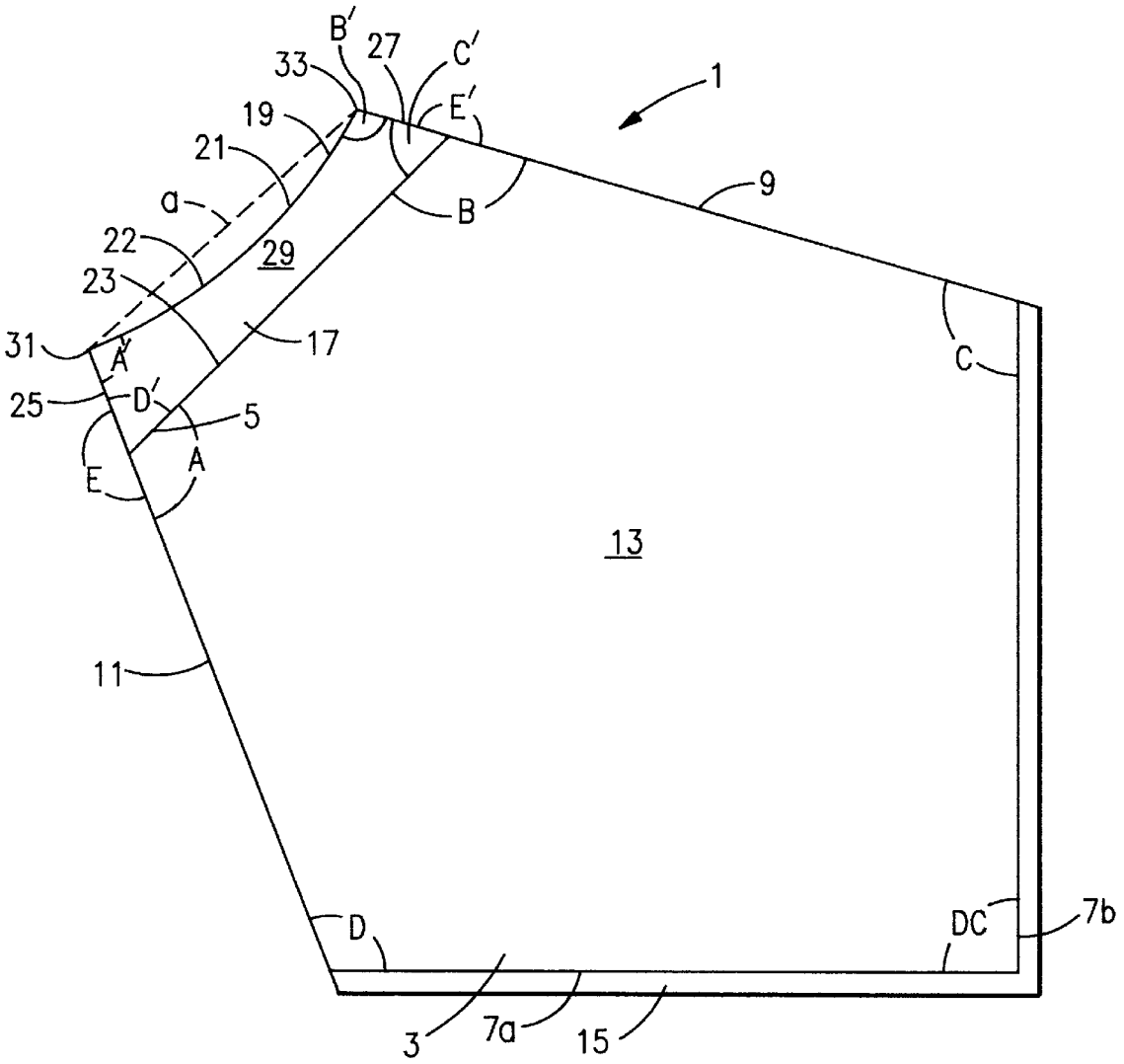
FIG. 4 represents a top elevational view of an additional embodiment of a masonry building unit that includes an inside corner curvilinear portion formed of a glaze composition.

The angle C' formed by the intersection between the side face 27 of the glaze portion and the back face 23 of the glaze portion may also vary depending upon the embodiment and application. In the embodiments shown in FIGS. 1–3, the angle C' is about 45°. On the other hand, the angle C' in the embodiments shown in FIGS. 5–8 is about 90°. In FIG. 4, the angle C' is about 60°. However, as with all of the angles formed by the intersection of any of the faces of the glaze portion, angle C' may vary, depending upon the embodiment and the application, including the above-discussed factors.

The angle D' is formed by the intersection between the back face 23 of the glaze portion and the side face 25 of the glaze portion. In the embodiments shown in FIGS. 1, 2, 7, and 8, the angle D' is about 90°. In the embodiments shown in FIG. 3, 5, and 6, the angle D' is about 45°. On the other hand, the angle D' in the embodiment shown in FIG. 4 is about 60°. However, the angle D' may also vary depending upon a variety of factors, including those discussed above.

The angles E and E' are formed by the intersection between the side faces or portions thereof of the glaze portion 17 and the side faces or portions thereof of the base unit 3. In some embodiments, the side faces of the glaze portion are co-planar with the side faces or portions thereof of the base unit. Such embodiments include those shown in FIGS. 1–4, 7, and 8. In these embodiments, both side faces of the glaze portion are substantially co-planar with the side faces or portions thereof of the base unit. Therefore, the angles E and E' are about 180°.

Figure 5:
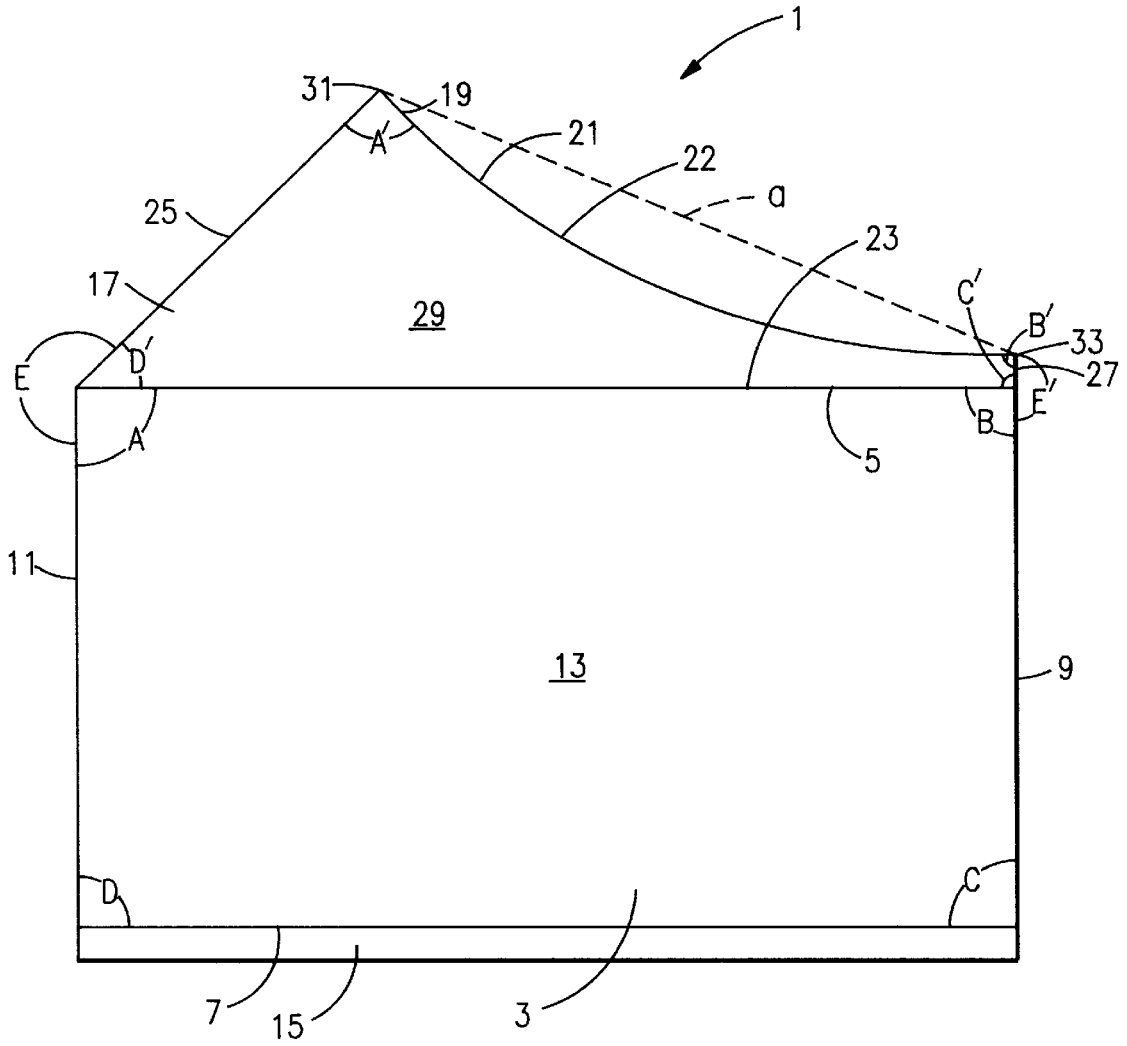
FIG. 5 represents a top elevational view of another additional embodiment of a masonry building unit that includes an inside corner curvilinear portion formed of a glaze composition.
Figure 6:
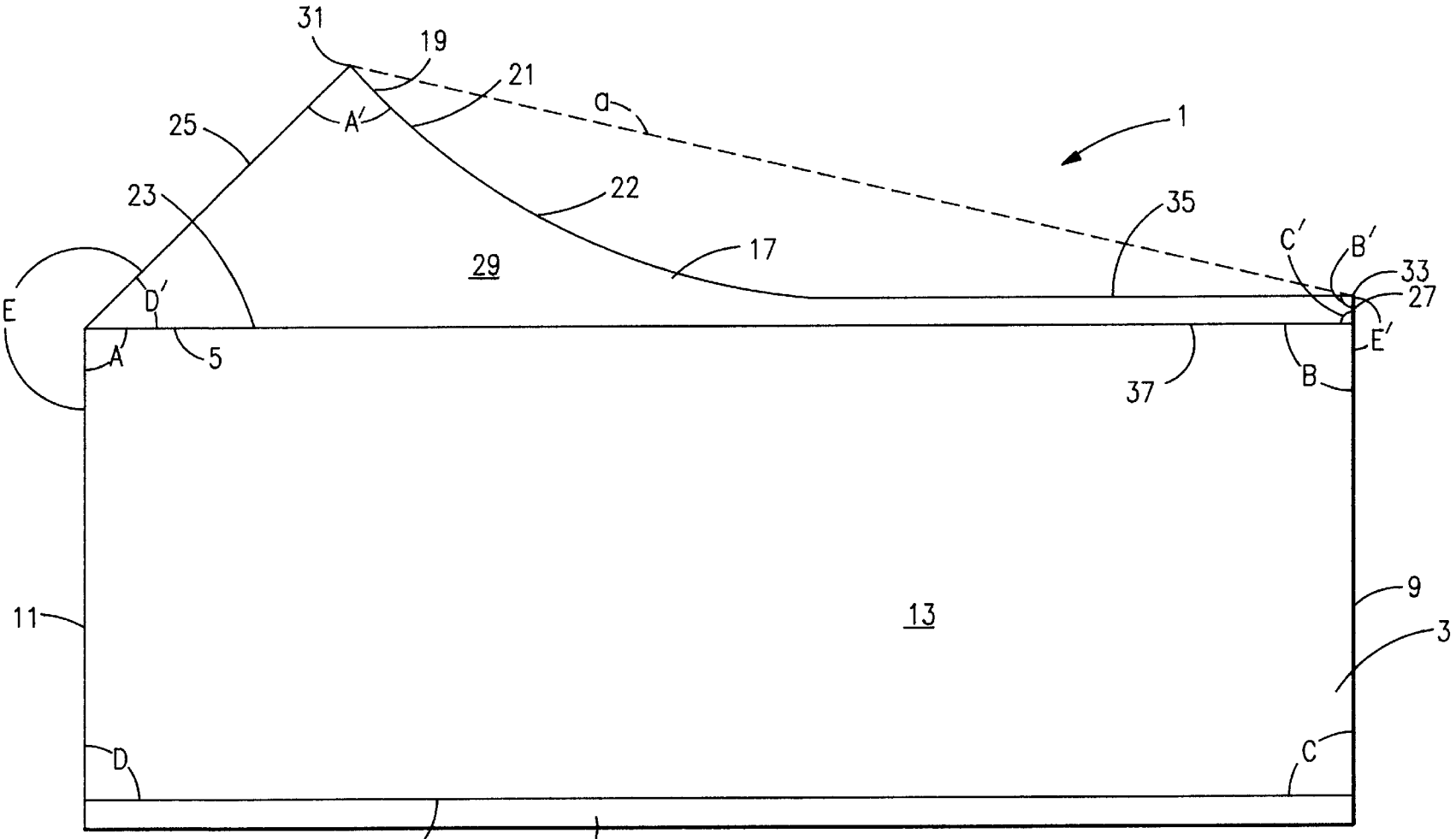
FIG. 6 represents a top elevational view of further additional embodiment of a masonry building unit that includes an inside corner curvilinear portion formed of a glaze composition.
Figure 13:
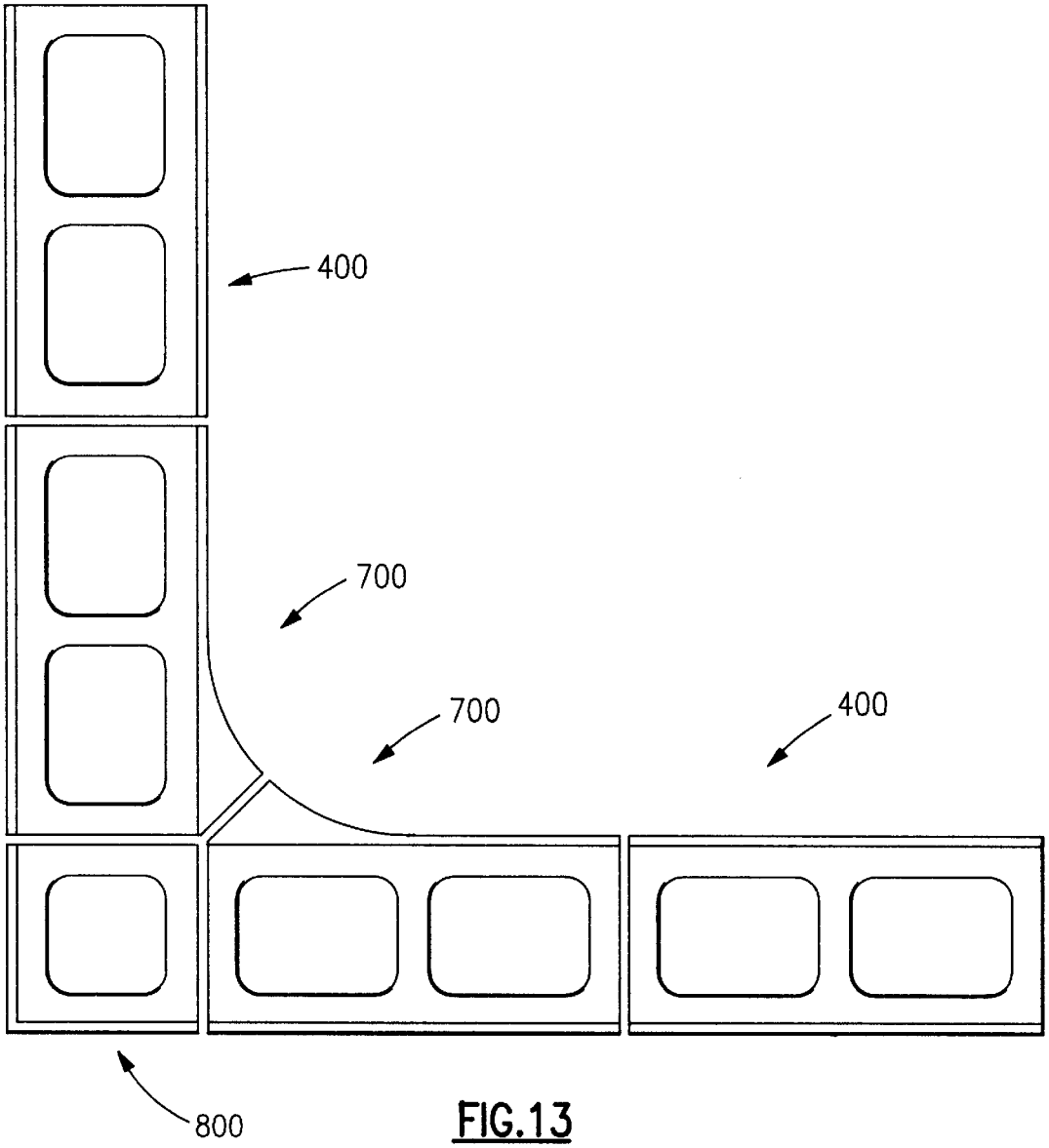
FIG. 13 represents a top elevational view of a further embodiment of a section of wall.

In other embodiments, such as those shown in FIGS. 5 and 6, the side face 25 of the glaze portion is not co-planar with the side face 11 of the base unit. Forming an angle E between these side faces may be desired so as to form a wall as is shown in FIG. 13. In the embodiments shown in FIGS. 5 and 6, the angle E between the side face 25 of the glaze portion and the side face 11 of the base unit is about 135°. However, the angle formed by the intersection between a side face or a portion thereof of the glaze portion 17 and the side face or a portion thereof of the base unit 3 may vary, depending upon the embodiment and the application. For example, the angle that a wall corner incorporating a unit according to the invention is meant to span and the number of units used to turn the corner may affect the angle.

The number of degrees of arc represented by the inside corner curvilinear portion 22 of the surface 21 of the front face 19 of the glaze portion 17 of the unit 1 is variable. In the embodiment shown in FIG. 1, the curvilinear portion 22 of the surface 21 of the front face 19 of the unit 1 represents a section of a circle having about radius of about 7.375 inches. The linear length of the arc is about 5.8 inches, representing approximately 44° of such a 7.375 inch radius circle. The corners 31 and 33 of the glaze portion 17 represent the ends of the curvilinear portion 22 of the surface 21 of the front face 19. The corners 31 and 33 are separated by linear distance "a" of about 5.75 inches. However, since the size of the glaze portion 22 of the unit 1 may vary, any and all of the above-discussed dimensions may vary in a similar embodiment. Also, as described below, the invention includes may different embodiments that could include vastly different dimensions.

In a typical inside corner curvilinear masonry building unit according to the present invention, a curvilinear portion 22 of the surface 21 of the front face 19 of the glaze portion 17 of the unit 1 may be from about one-sixteenth of the circumference circle (22.5°) to about one-quarter of the circumference of a circle (90°). The curvilinear portion may also be a larger or smaller arc section.

For example, in the embodiment shown in FIG. 3, the curvilinear portion 22 is also a section of a circle with a 7.375 inch radius. However, the curvilinear portion 22 of the surface 21 of the front face 19 of the masonry building unit 1 shown in FIG. 3 represents a greater portion of that circle, about 90°, than the curvilinear portion 22 of the unit shown in FIG. 1. In the embodiment shown in FIG. 3, the ends points 31 and 33 of the curvilinear portion may be about 10.43 inches apart in straight line distance "b". However, the size of the curvilinear portion may be the same as the embodiment shown in FIG. 1 or 3 or may be larger or smaller, depending upon the application.

Further, although the curvilinear portions 22 of the surface 21 of the front face 19 of the building units shown in FIGS. 1–8 comprise a curvilinear section substantially similar to a portion of a circumference of a circle, the curvilinear portion may be formed according to another curve, such as parabolic, hyperbolic, and/or any other curve.

As in the embodiment shown in FIG. 2, the surface 21 of the front face 19 of the glaze portion 17 of the masonry building unit 1 may also include a planar portion 35 that is also opposite to the back face 23 of the glaze portion. Preferably, the planar portion 35 blends into the curvilinear portion 22 without forming a sharp distinct angle or corner. The base unit 3, in embodiments in which the glaze portion includes a planar portion, preferably includes a planar portion opposite the planar portion of the glaze portion to support the planar portion of the glaze portion.

In further embodiments, the surface of the front face of a glaze portion of a unit may comprise two planar portions joined to the curvilinear portion on opposite sides. In such embodiments, the planar portions may be of different or may be the same length. The second planar portion preferably is also opposite and supported by a portion of the front face of the base unit.

Whether the front face of the curvilinear masonry building unit includes one or two planar portions, the planar portions may be of any length. The length of the planar portion(s) of the front face is not dependent upon the length of the curvilinear portion of the front face. Similarly, the length of one or the other of the planar portions in an embodiment including two planar portions is not dependent upon the other planar portion.

Whether or not the surface 21 of the front face 19 includes one or two planar portions may depend upon how the unit is being used and, for instance, the space in which a corner is desired to be turned. If the corner is to be turned in a relatively short distance, the planar portions may be relatively short or only one planar portion may be in the present invention. However, two planar portions may be included in the present invention and still allow a tight corner to be formed. For instance, the curvilinear portions of the front face 2 of the curvilinear masonry building unit 1 of the present invention may represent an arc of a large number of degrees therefore eliminating the necessity of turning a corner with more than one curvilinear masonry building unit.

Overall, as can be seen in FIG. 1, the glaze portion 17 may increase in thickness toward one end of the base unit 3. In this embodiment, the glaze portion 17 increases in thickness toward the left of the base unit 3. However, the thickness of the glaze portion may vary, depending upon the desired shape of the surface of the glaze portion and the shape of the surface of the base unit. For example, the glaze portion in the embodiment shown in FIG. 3 is thinner toward both the right and left sides, tapering to a point. The glaze portion in this embodiment also thins toward the center, the deepest section of the curvilinear portion of the surface of the front face of the glaze portion. The glaze portion may also be thinner if it coats a planar portion of a base unit as toward the left-hand side of the embodiment shown in FIG. 2.

The dimensions of a completed masonry unit according to the invention, including the glaze portion and the base unit, may vary. For example, the side face of a typical embodiment of a whole unit 1 similar to the embodiments shown in FIGS. 1 and 2, including the side face 11 of the base unit and side face 25 of the glaze portion, may be from about four inches to about twelve inches. The length of the side face 11 of the base unit of the embodiments shown in FIGS. 5 and 6 may be about the same length. However, the additional side face 25 of the glaze portion may be about one-half the length of the side face 11 of the base unit.

The side face 9 of the base unit in the embodiments shown in FIGS. 1 and 2 will vary, depending upon the angle formed by the intersection between the side face and the front and back face of the base unit. The side face 9 of the base unit may be from about 4.5 to about 17 inches in embodiments in which the side face 11 varies from about 4 to about 12 inches. The side face 27 of the glaze portion 17 of the embodiments shown in FIGS. 1 and 2 may add an additional about 2.5 to about 10 inches to the side face of the entire unit. The side faces of the unit shown in FIG. 3, including the glaze portion and the base unit may be from about 4 to about 12 inches. The portions of the side face provided by the base unit and the glaze portion depends upon, among other factors, the curvature of the curvilinear portion of the glaze portion and the desired thickness of the glaze portions and base unit.

The back face of the embodiment shown in FIG. 1 may be from about 6 to about 24 inches long. Also, in the embodiment shown in FIG. 2, the back face of the back unit may be from about 9 to about 36 inches long. Further, in the embodiment shown in FIG. 3, each portion 7*a* and 7*b* of the back face may be from about 6 up to about 24 inches long. Additionally, in the embodiment shown in FIG. 4, each of the portions of the back face may be from about 3 to about 12 inches. In the embodiments shown in FIGS. 5–8, the back face may be from about 6 to about 24 inches long.

In embodiments of the present invention in which the front face 19 of the glaze portion includes a planar portion such as the planar portion 35, the base unit 3 preferably also includes an extended planar portion 37 supporting the glaze portion as shown in FIG. 2, for example. In an embodiment in which the front face 19 of the glaze portion includes two planar portions, one intersecting each of opposite sides of the curvilinear portion 22 of the front face 19 of the glaze portion 17, the base unit may include two extended planar portions. In the embodiments shown in FIGS. 2, 6, and 8, the base unit is extended, as compared to the embodiments shown in FIGS. 1, 5, and 7, about the same distance as the planar portion 35 intersecting the curvilinear portion 22 of the front face 19 of the glaze portion.

Figure 8:
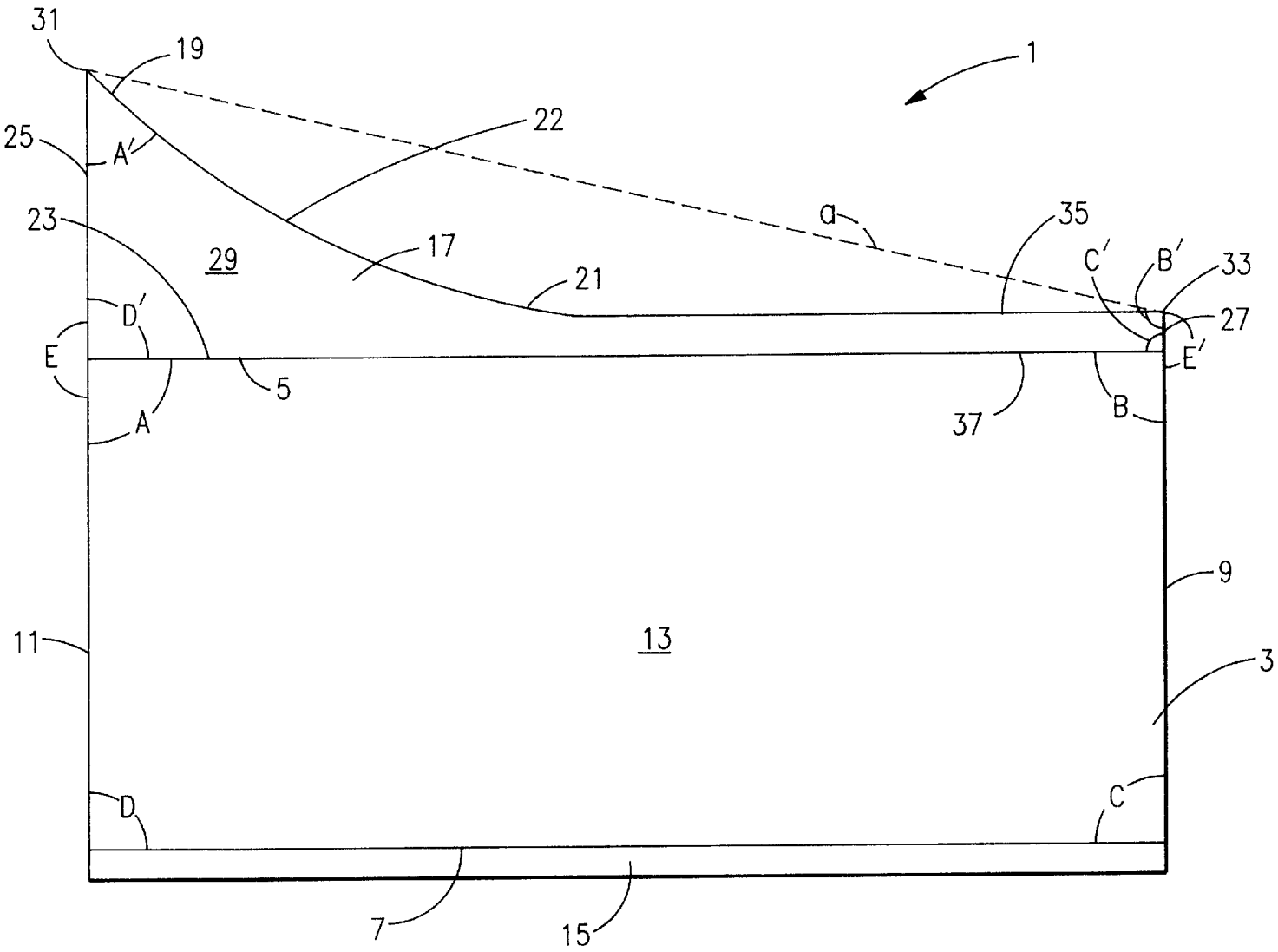
FIG. 8 represents a top elevational view of a still further embodiment of a masonry building unit that includes an inside corner curvilinear portion formed of a glaze composition.

In the embodiments shown in FIGS. 2, 6, and 8, the planar portion of the front face of the glaze portion is about 7.625 inches long. Similarly, in these embodiments, the length that the base unit 3 is extended as compared to the embodiments shown in FIGS. 1, 5, and 7 is also about 7.625 inches. However, the planar portion of the front and the extension of the base unit may be formed of any length. Typically, the length of the planar portion(s) is about one-half of the length of a typical stretcher unit shown in FIG. 9 and as described below.

Additionally, in typical embodiments, the height of the inside corner curvilinear masonry building units of the invention may be from about 2 inches to about 16 inches. This distance typically represents the distance between the top face 29 and the bottom face of both the glaze portion and the base unit. If the top and bottom faces of the glaze portion and base unit are both planar and coplanar, then the height will be uniform over the entire unit. However, the height may vary, if the top and bottom faces are not planar, parallel, and/or co-planar.

In any embodiment of the invention, the faces of the finished masonry building unit may be of any desired length for a particular application and also depending upon the desired structural strength of the unit. Also, although the intersections between the faces of the base unit with each other, the faces of the glaze portion with each other, or the faces of the base unit with the faces of the glaze portion are shown as sharp, well defined corners in the embodiments shown in the Figures, if desired, the intersection faces can be rounded off or truncated.

Figure 16:
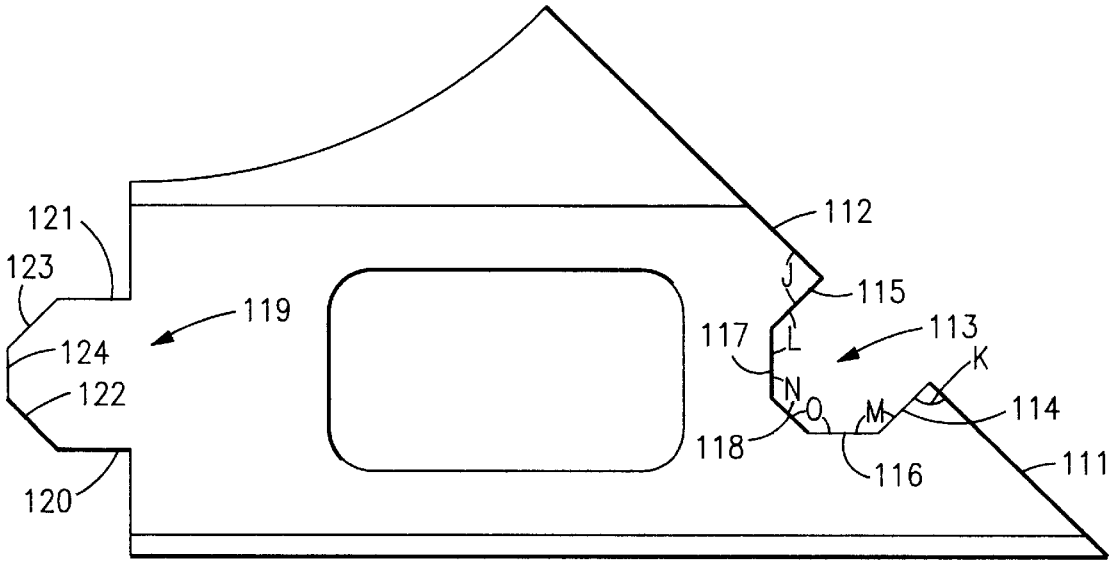
FIG. 16 represents a top elevational views of another embodiment that has a cut-out portion in one side wall and a protuberance extending from another side wall.

In some embodiments of the present invention, the side faces of the base unit, glaze portion or entire unit, whether they include one or more planar or other shaped portions, may include two end segments 81 and 82 with a cut-out portion 83 located therebetween. In an example of such an embodiment, as shown in FIG. 16, the end segments 81 and 82 may be planar and are typically about one to about two inches long. A cut-out portion 83 located between the segments may be between about three and about six inches wide. The size of the end segments 81 and 82 and the cut-out portion may be larger or smaller, depending upon the size of the curvilinear masonry building unit and the application. The cut-out portion may include opposing side walls 84 and 85 which may be of variable length depending upon the size of the cut-out portion 83 desired. In a typical embodiment, the side walls 84 and 85 are about one inch long.

The side walls 84 and 85 preferably intersect the segments 81 and 82 of the side faces 9 or 11 at an angle F and G, respectively. The angle which is preferably, but not necessarily, about a 90° angle or less. Also, these side walls 84 and 85 intersect further side walls 87 and 86, respectively, with an angle H and I, respectively. Angles H and I, which may vary depending upon the number of side walls included in the cut-out portion in a typical embodiment, are about 135°.

Figure 17:
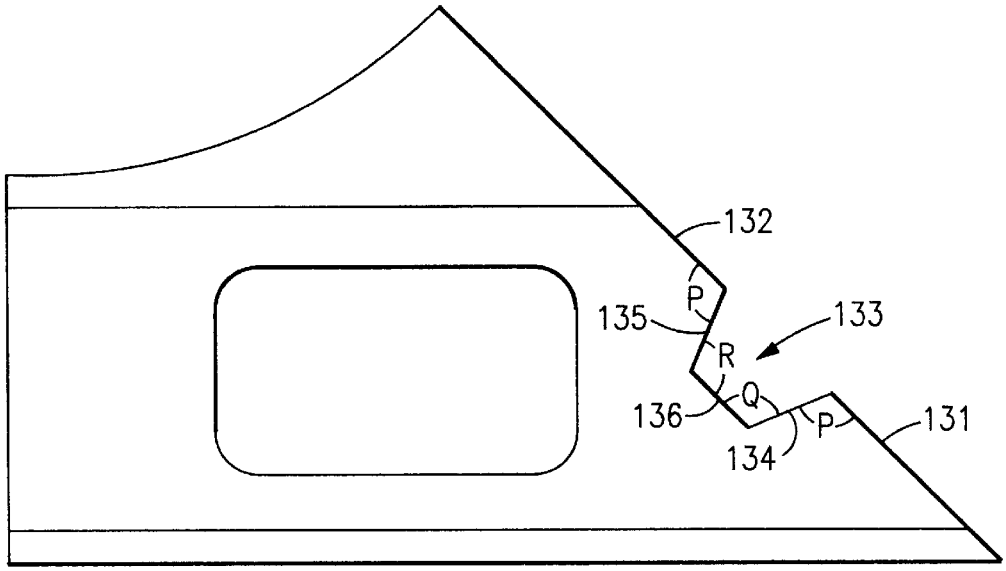
FIG. 17 represents a top elevational view of an embodiment that includes a cut-out portion in one side wall.

The side faces may include two end segments 111 and 112 with a cut-out portion 113 located therebetween. In this embodiment, shown in FIG. 17, the end segments 111 and 112 may be planar and are typically about one to two inches long. A cut-out portion 113 located between the segments may be between four and six inches wide. The cut-out portion may include opposing side walls 114 and 115 which may be of variable length depending upon the size of the cut-out portion 113 desired. The size of the end segments 111 and 112 and the cut-out portion may be larger or smaller, depending upon the size of the curvilinear masonry building unit and the application. In a typical embodiment, the side walls 114 and 115 are about one inch long.

The side walls 114 and 115 preferably intersect the segments of the side faces 111 and 112 at an angle J and K, respectively, which is preferably, but not necessarily, a 90°. Also, these side walls 114 and 115 intersect further side walls 116 and 117, respectively, with an angle L and M, respectively. Angles L and M, which may vary depending upon the number of side walls included in the cut-out portion in a typical embodiment, are about 135°.

In this embodiment, preferably, the walls 116 and 117 intersect a bottom portion 118 of the cut-out portion at angles N and O, respectively. Angles N and O in a typical embodiment are about 135°. Also in a typical embodiment, walls 116 and 117 are about 2.0 inches, bottom wall is about 2.50 inches wide. Preferably, in a typical embodiment the cut-out portion 113 is about 2.50 inches deep.

This embodiment may also include a protuberance 119. The protuberance 119 may be similarly shaped to the cut-out portion 113. Accordingly, the lengths of the segments 120–124 making up the protuberance may be similar to the lengths of the corresponding segments 114–118 forming the cut-out portion. For instance, segment 120 of the protuberance may be about the same length as the segment 114 of the cut-out portion. Similarly, the angles at which the segments 120–124 intersect may be similar to the corresponding angle between the corresponding segments of the cut-out portion. Providing the protuberance with segments of a similar length to and arranged at similar angles as the segments of the cut-out portion may allow two units to be arranged in a wall or other structure so that the protuberance of one unit enters the cut-out portion of the adjacent unit. However, the protuberance and cut-out portions may be of any size and shape. Curvilinear masonry building units according to the present invention may also include one protuberance and no cut-out portions, or one cut-out portion and no protuberances, or two protuberances or cut-out portions.

Figure 18:
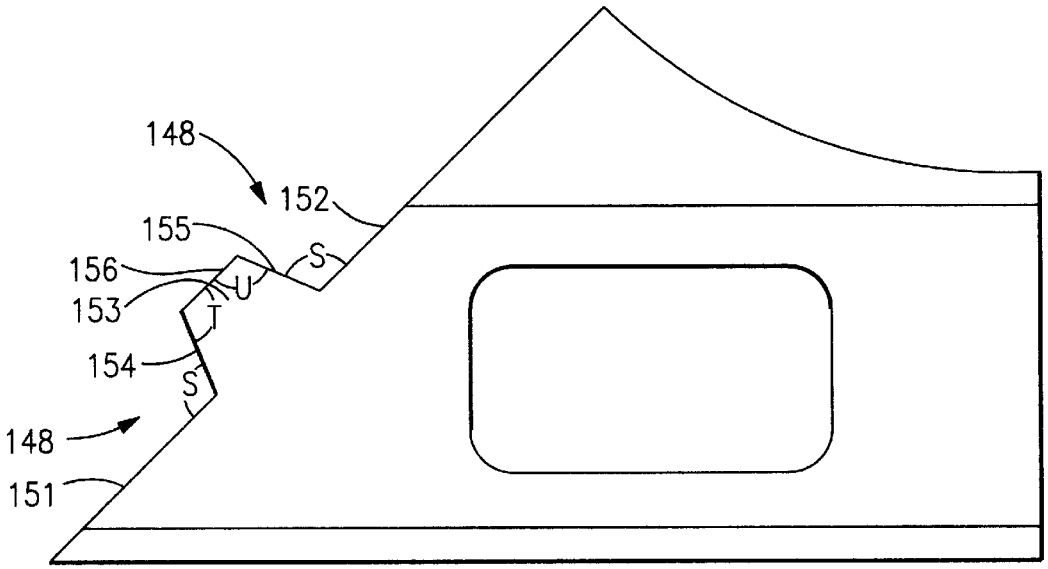
FIG. 18 represents a top elevational view of an inside corner curvilinear masonry building unit according to the invention having a protuberance portion that mates with the cut-out portion in the side wall shown in FIG. 17.

In an alternative embodiment, shown in FIG. 18, the cut-out portion may be bordered by side wall portions about 1.625 inches long and about 5.75 inches long. The cut-out portion in this embodiment is about 6.875 inches wide. The side walls intersect side walls 134 and 135 of the cut-out portion which in this embodiment are, respectively, about 3.625 inches long. Side walls 134 and 135 intersect segments 131 and 132, respectively, at the angle P which is preferable but not necessarily a 135° angle. Also, side walls 134 and 135 intersect bottom portion 136 of the cut-out portion, respectively, Q and R, which in this embodiment are each about 135°. The bottom portion 136 of the cut-out 133 in this embodiment is about 1.75 inches long and the cut-out portion is about 1.50 inches deep.

Figure 19:
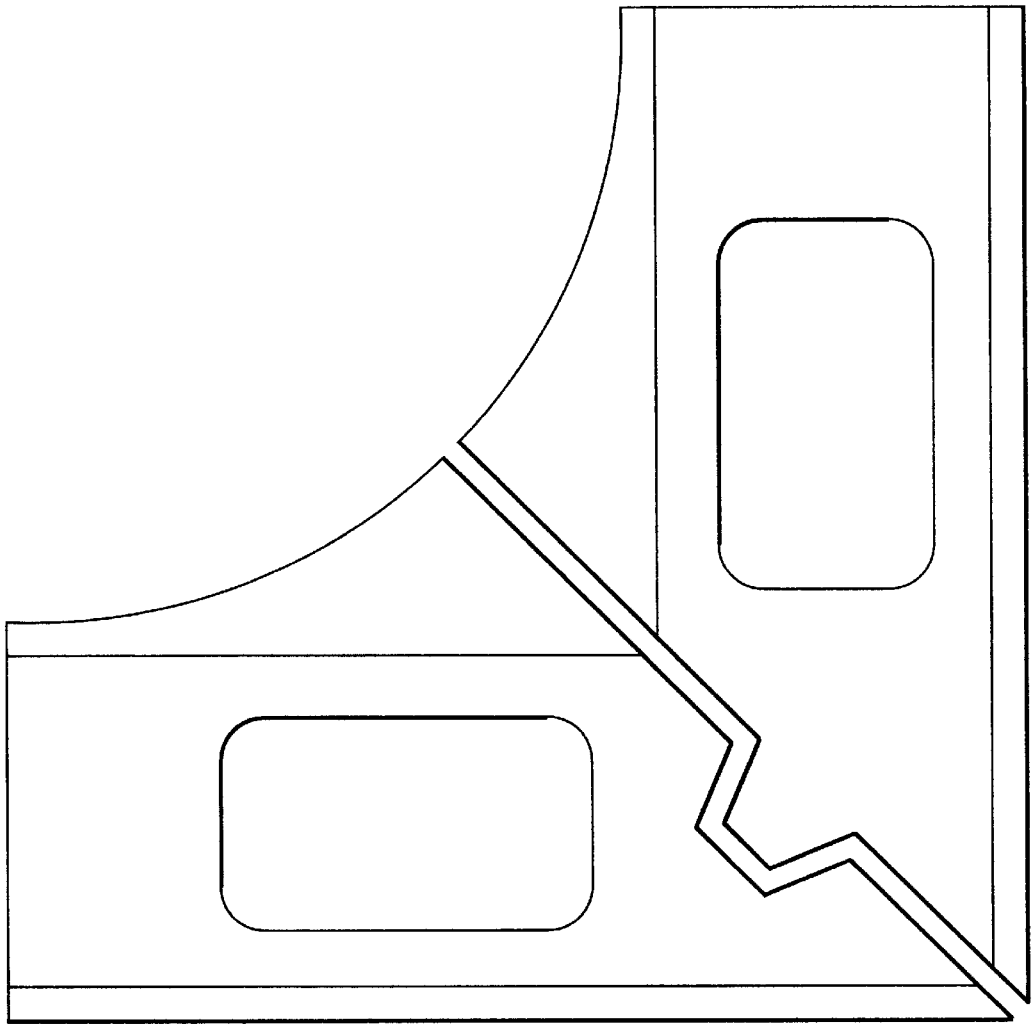
FIG. 19 represents a top elevational view of the curvilinear masonry building units shown in FIG. 17 and 18 juxtaposed.

FIG. 19 shows an alternative embodiment of protuberance. This embodiment of the protuberance portion 153 is designed to mate with a cut-out portion of the side wall as described above and as shown in FIG. 18. The side face 148 of such a masonry building unit preferably includes portions 151 and 152 with a protuberance 153 located therebetween. In this embodiment, side face portion 151 preferably is about 1.75 inches long, side face portion 152 preferably is about 5.75 inches long and the protuberance portion is about 6.875 inches wide at its widest. Preferably, the protuberance portion is tapered and includes opposing side walls 154 and 155 which, in this embodiment, are about 3.625 inches long. Side walls 154 and 155 intersect side face portions 151 and 152 respectively, at an angle S which is preferably, but not necessarily a 135°. Side walls 154 and 155 intersect wall 156, respectively, at angles T and U. Angles T and U in this embodiment are each preferably about 135°.

Figure 20:
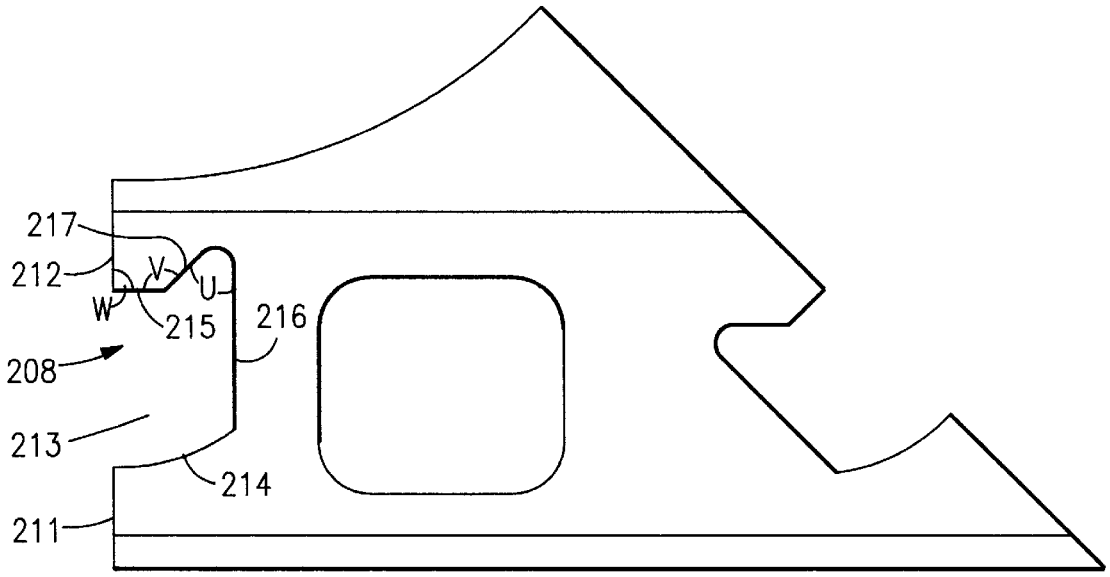
FIG. 20 represents a top elevational view of an inside corner curvilinear masonry building unit having a cut-out portion in a side wall pursuant to an alternative embodiment on the present invention.

FIG. 20 shows how two curvilinear masonry building units according to the present invention that include a protuberance portion and a cut-out portion and are oriented with respect to each other in a structure including such masonry units.

Figure 21:
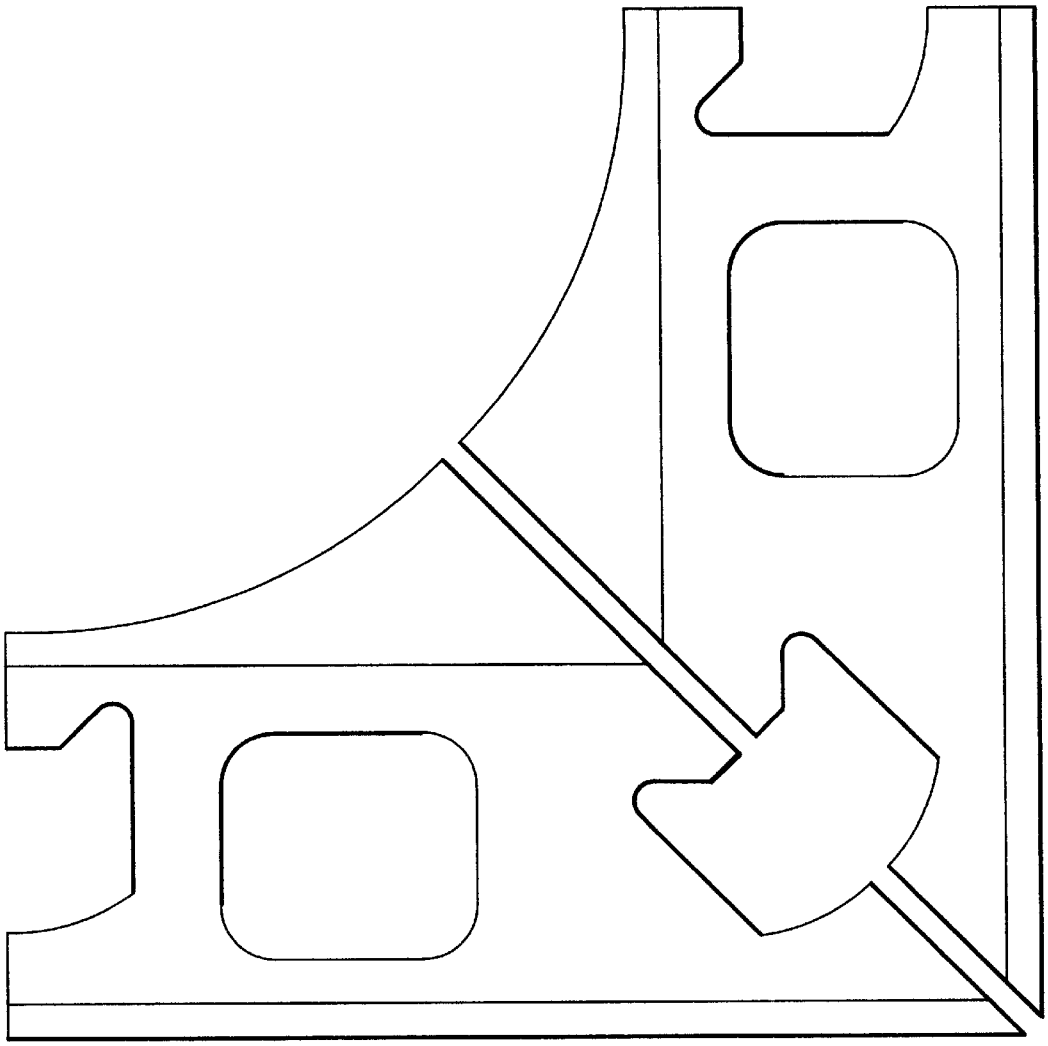
FIG. 21 represents a top elevational view of a corner turn employing two of the masonry units pursuant to FIG. 20.

FIG. 21 is a top elevational view of a masonry building unit including an alternative embodiment of a cut-out portion in a side wall. The cut-out portion in this embodiment provides for enhanced structural reinforcement of a corner fabricated using such a unit. The reinforcement can be provided by providing a mortar bed in the recess (e.g.-"buttering the joint") or pouring cement in the recess created by the cut-out portion, and, if desired, reinforcing rods or other such structure can also be provided in the recess. The presence of the projection or "ear-like" portion in the cut-out portion provides for a physical interlock of adjoining masonry units (see also FIG. 22).

The cut-out portion included in the side face of the curvilinear masonry building unit merely needs to large enough to provide the desired additional strength with the maximum size being primarily limited by merely assuring the integrity of the building unit during handling and construction and by economics. In addition, the location of the cut-out portion is typically such that the length of the side wall adjacent to each end of the cutout portion is at least 1.5 inches and preferably about 1.65 inches to ensure against a portion of a block breaking off during handling and construction. The additional projection in the cut-out portion typically extends at least about one-eighth inch beyond the main body of the cut-out portion. The specific dimensions for the cutout portion and location for a particular embodiment can be determined by those skilled in the art once aware of this disclosure without undue experimentation.

The embodiment of the present invention showing FIG. 21 can be provided in the form of an unglazed or raw block as well as a glazed block. The front face of the curvilinear masonry building unit includes a curvilinear portion that is opposite to a back face of the unit. The front face may also include one or more planar portions intersecting a curvilinear portion and the side faces.

In the embodiment shown in FIG. 21 side face 208 includes portions 211 and 212 with cut-out portion 213 located therebetween. In this embodiment, portion 211 is about 1.75 inches long, portion 212 is about 4.0 inches long and cut-out portion 213 includes opposing side walls 214 and 215. In this embodiment, wall 215 is about 0.75 inch long. Side wall 215 intersects segment 216. Side wall 214 intersects projection 217.

Figure 22:
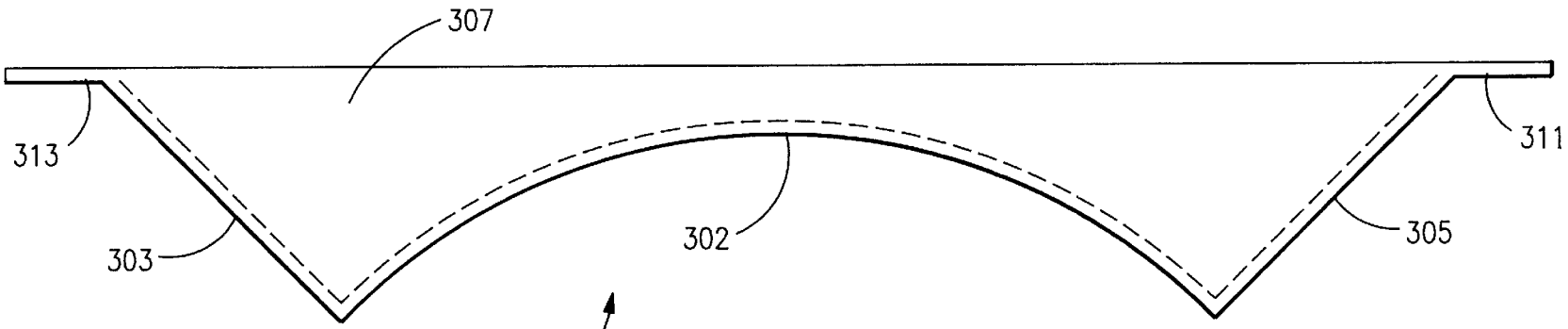
FIG. 22 represents a cross-sectional view of one embodiment of a mold used in applying a glaze composition to a face of a masonry building unit according to a method of the present invention thereby forming a curvilinear portion.

Recess 217 extends beyond the main body of cut-out portion 213 and beyond one of the side walls of the cut-out portion. In the embodiment shown in FIG. 21, recess 217 extends beyond side wall 215 toward the front face of the base unit. The projection, upon application of mortar or cement, provides for mechanical interlocks which can not be pulled apart without destroying the block itself. Angles U, V, and W are 75°, 120°, and 90° respectively, in this embodiment. FIG. 22 shows two masonry units similar to the embodiment shown in FIG. 21 juxtaposed.

With any of the above-described inside corner curvilinear masonry building units including a cut-out portion in the side face, either one or both of the side faces may include a cut-out or protuberance portion. The cut-out portion(s) may abut a stretcher member, two stretcher members, a curvilinear masonry building unit according to the invention or any other curvilinear masonry building unit and a stretcher member, or two of any type of curvilinear masonry building units. The surface of the abutting unit(s) may or may not include a cut-out or protuberance portion. Alternatively, a curvilinear masonry building unit according to the present invention may include a cut-out portion in only one side face. Similarly to units including two cut-out portions, units including one cut-out portion may also abut a stretcher member, two stretcher members, a curvilinear masonry building unit and a stretcher member, or curvilinear masonry building units. Again, the surface of the abutting unit(s) may or may not include a cutout or protuberance portion.

In an embodiment in which the side face includes a protuberance, the side face of a curvilinear masonry building unit may include one protuberance and one corresponding cut-out portion. Alternatively, a unit may include a protuberance formed on one side face and a planar surface on the other side face. Further, a curvilinear masonry building unit according to the present invention may include two protuberances received by abutting curvilinear or stretcher units.

As is evident from the above discussion, a curvilinear masonry unit according to the present invention may include any desired configuration of side wall cut-out and protuberance portions. The number and size of the cut-outs and protuberances may depend upon the application in which the units are used.

Figure 9:
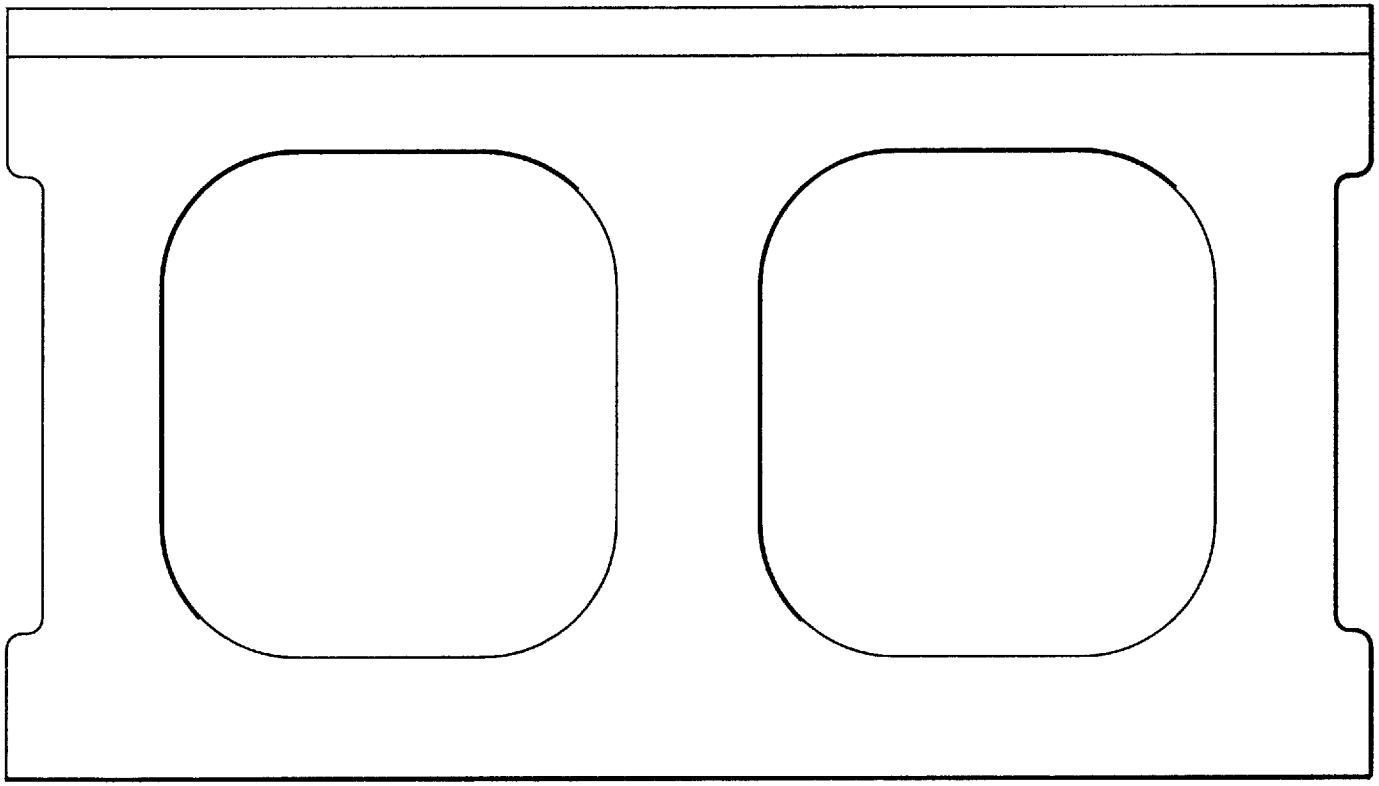
FIG. 9 represents a top elevational view of a stretcher masonry building unit which may be used in an embodiment of a wall corner wall corner composite according to the present invention.

FIG. 9 shows a stretcher member which may be used in walls incorporating curvilinear masonry building units according to the present invention. Such a stretcher may also form a base unit of a curvilinear masonry building units according to the present invention.

Figure 10:
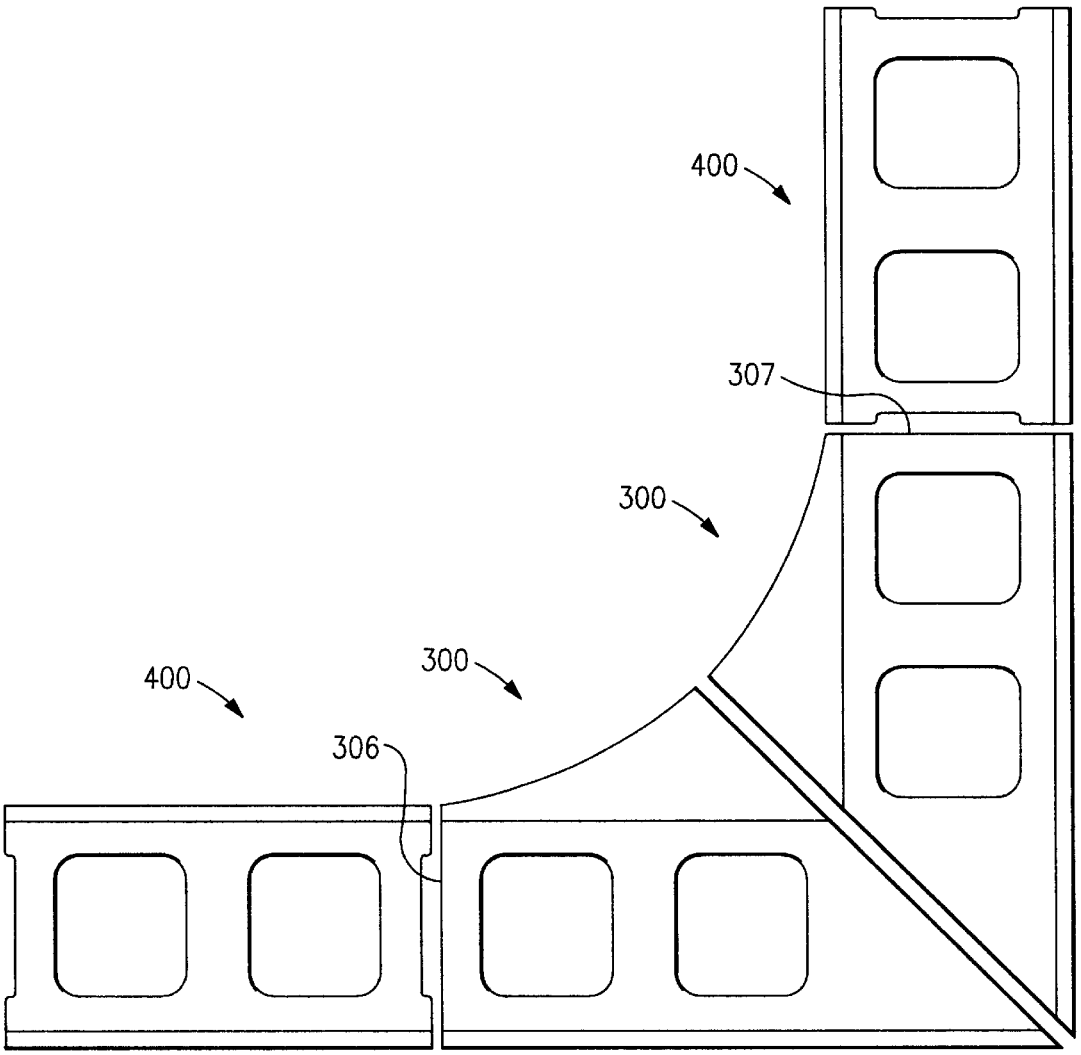
FIG. 10 represents a top elevational view of one embodiment of a section of wall according to the present invention including an embodiment of a masonry building unit of the invention.

FIG. 10 shows one embodiment of a wall including units according to the invention and stretcher units. This wall includes two curvilinear masonry building units 300 similar to that shown in FIG. 1. Abutting the side walls 306 and 307 of each of masonry building units 300 is a stretcher member 400. The stretcher members 400 preferably are substantially similar to stretcher members shown in FIG. 9. A plurality of stretcher members may abut the curvilinear masonry building units extending the wall in the directions the side faces of the curvilinear unit. The angle of the corner formed in the wall shown in FIG. 10 is approximately 90°. As can be seen in FIG. 10, a glaze composition may be applied to the exposed faces of the curvilinear masonry building units and the stretcher members.

Figure 11:
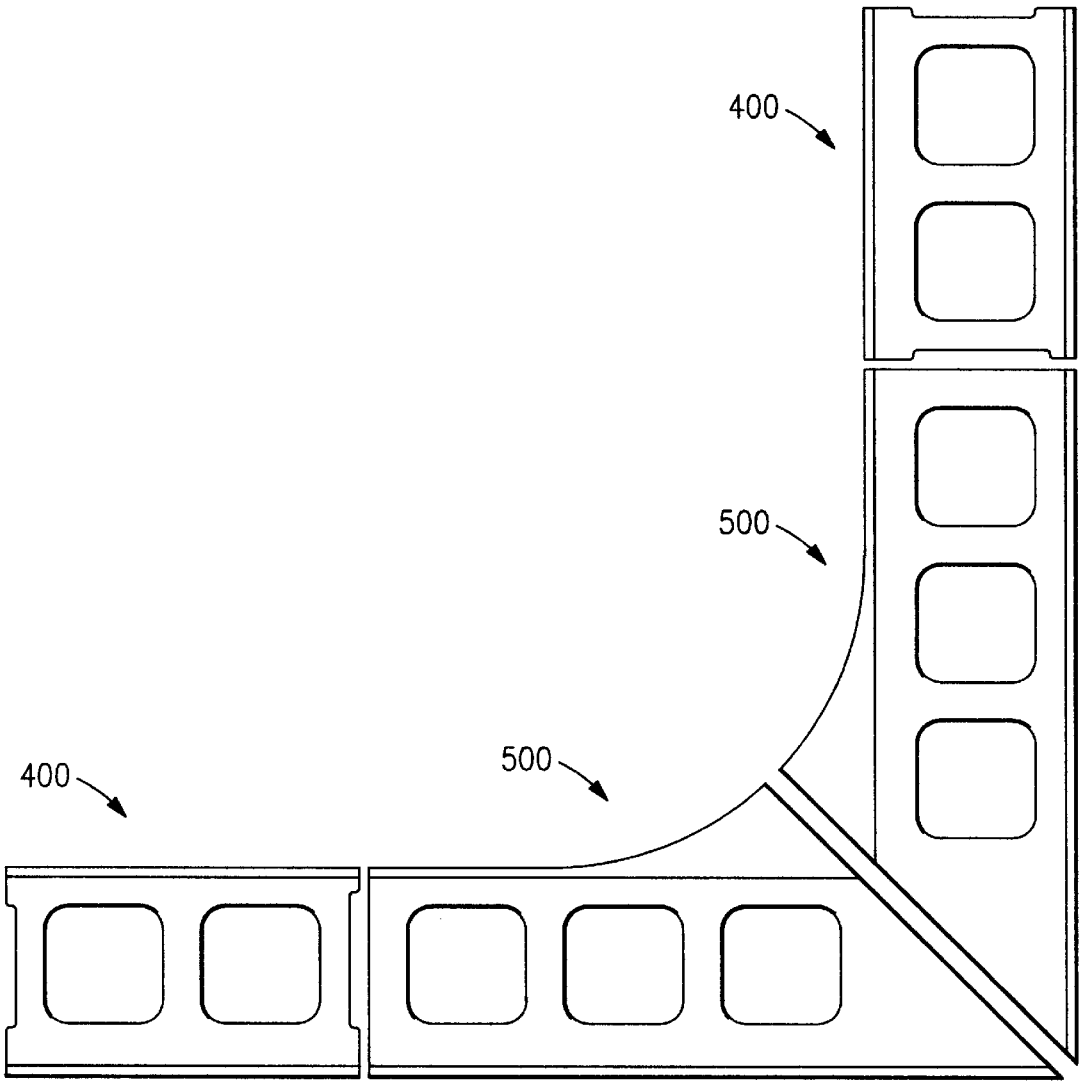
FIG. 11 represents a top elevational view of one embodiment of a section of wall according to the present invention, including an embodiment of a masonry building unit of the invention.

FIG. 11 shows an alternative embodiment of a wall including curvilinear masonry building units according to the present invention. The corner wall composite shown in FIG. 11 includes two curvilinear masonry building units 500 substantially similar to the units shown in FIG. 2. The corner turned by the wall composite shown in FIG. 11 is approximately 90°. As can be seen, a stretcher member 400 may abut the curvilinear masonry building units, thereby extending the wall in the directions the side faces of the units.

Figure 12:
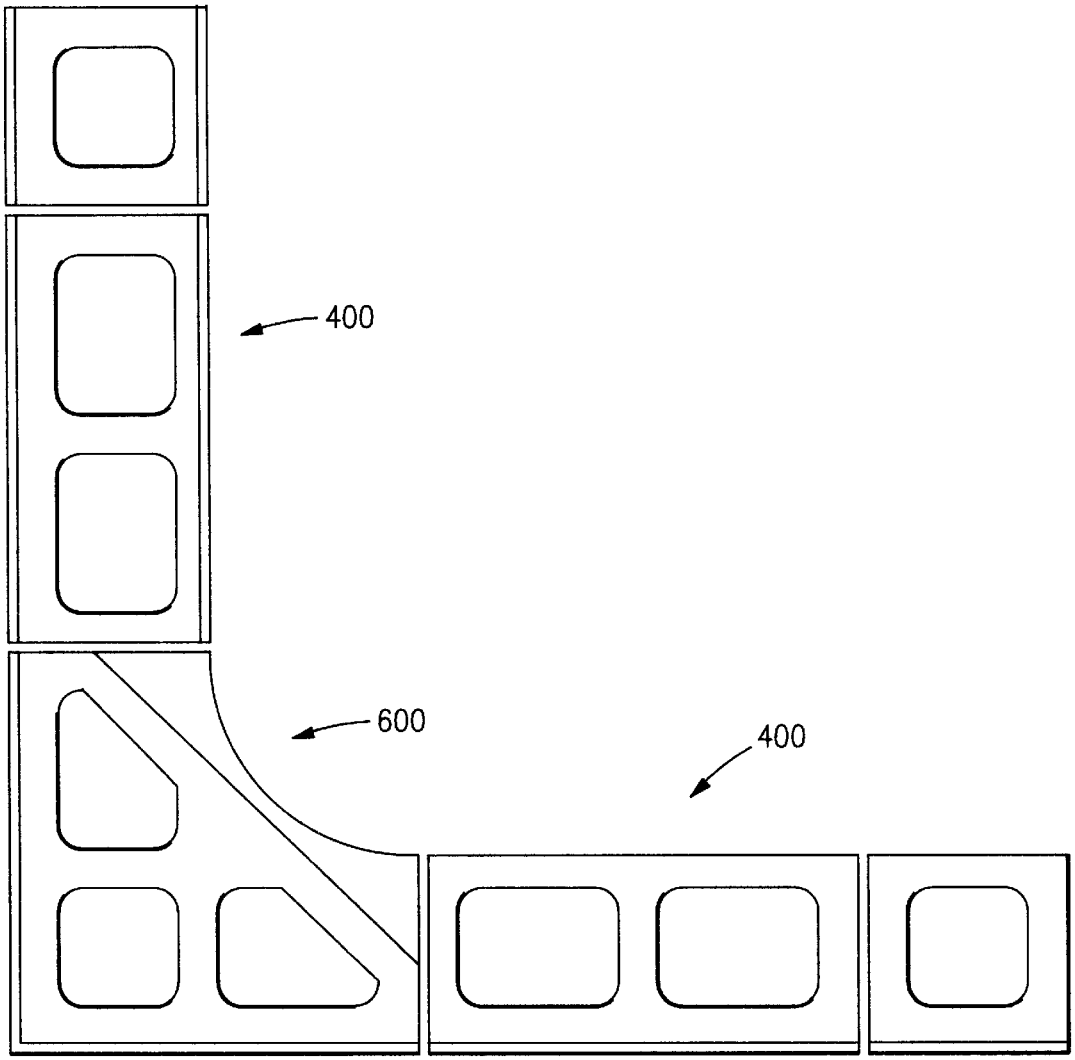
FIG. 12 represents a top elevational view of another embodiment of a section of a wall.

The wall composite shown in FIG. 12 includes a curvilinear masonry building unit 600 similar to the unit shown in FIG. 3. The embodiment shown in FIG. 12 includes a curvilinear portion that includes an arc from a circle having a radius of about 7.75 inches. Each portion of the back face of this embodiment is about 15.75 inches. However, the curvilinear portion, the portions of the back face, and any other face or portion thereof may include an arc of any size circle or a portion of any type of curve, depending upon the application.

FIG. 13 shows another embodiment of a corner wall composite formed using curvilinear masonry building units 700 according to the present invention. The masonry units 700 used to form the wall shown in FIG. 13 are substantially similar to those embodiments shown in FIG. 5. The wall corner composite shown in FIG. 13 may also include a unit 800 completing the corner.

The curvilinear portion of the unit 700 shown in FIG. 13 includes an arc representing a portion of a circle having a radius of about 7.75 inches. The back face in this embodiment is about 15.75 inches. The unit 800 in this embodiment has a square cross section, with each side being about 7,75 inches long. As with the other embodiments, these dimensions are only illustrative. The dimensions of these portions of the units shown in FIG. 13 and any other figure may be altered, depending upon the embodiment. The contours of the surfaces may also vary.

Figure 14:
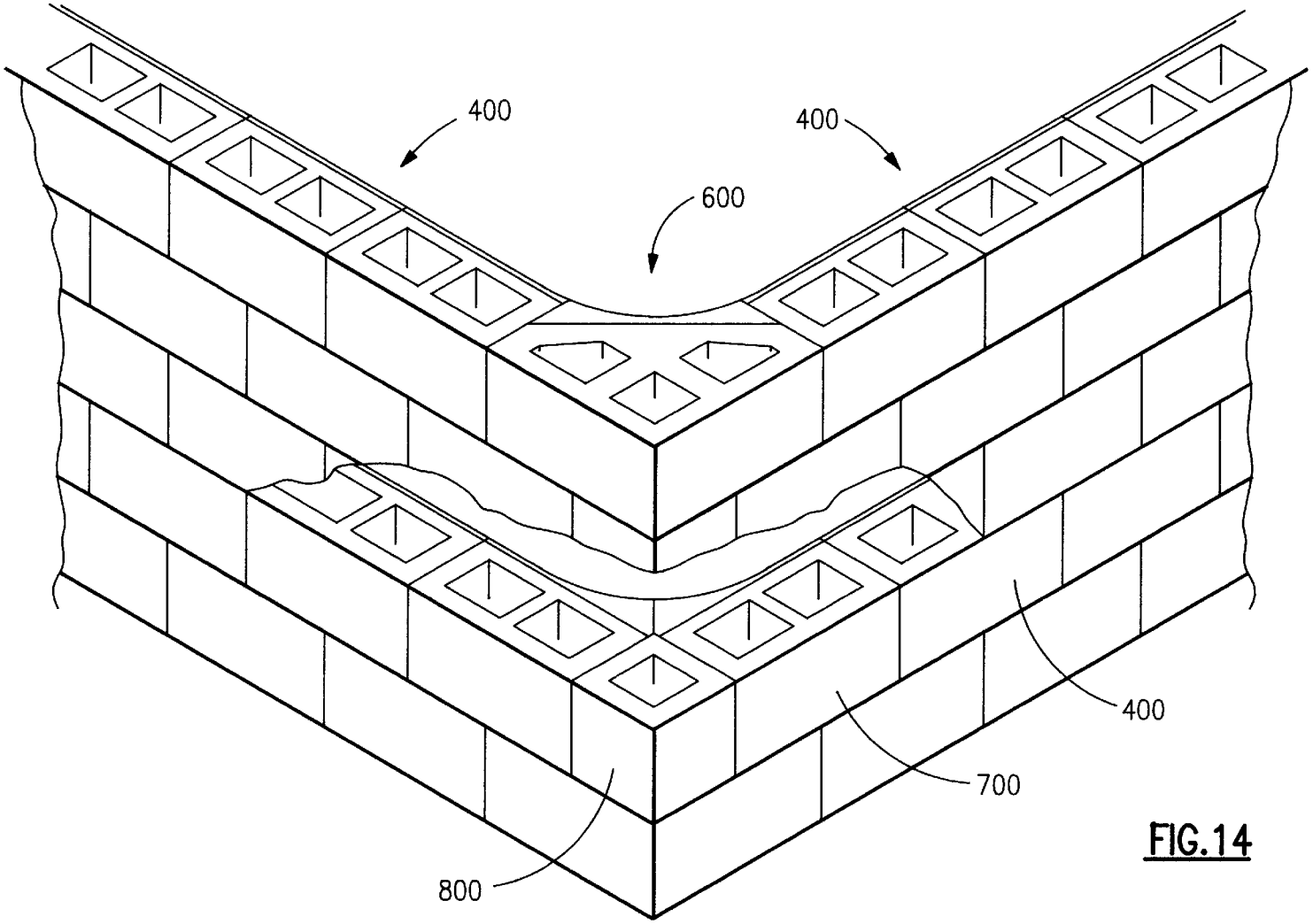
FIG. 14 represents a perspective view of one embodiment of a section of wall pursuant to the present invention including the embodiments of the masonry building unit shown in FIGS. 12 and 13.
Figure 15:
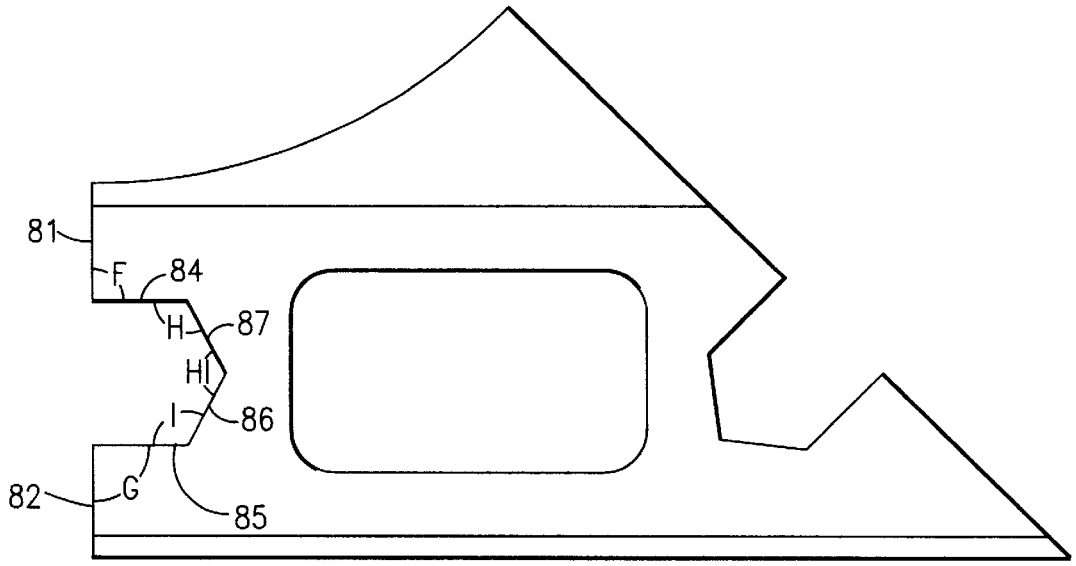
FIG. 15 represents a top elevational views of an embodiment of a masonry building unit that includes an inside corner curvilinear portion according to the invention that has cut-out portions in two side walls pursuant to an alternative embodiment of the invention.

The wall corner composite shown in FIG. 12 may be alternated in a wall with the wall corner composites shown in FIGS. 10, 11, and/or 13. All of the embodiments shown in FIGS. 10–13 may be used to turn a 90° corner. By alternating the embodiments of the corner wall composite shown in FIGS. 10–13, the masonry seams between the curvilinear masonry building units in the wall, as shown in FIG. 14, will be discontinuous, thereby providing additional strength to the wall and making it more architecturally aesthetic. Such a joinder of units in a wall is known as a running seam. FIG. 14 shows a wall including embodiments shown in FIGS. 12 and 13.

The embodiments of corner wall composites shown in FIGS. 10–13 are only examples of corner wall composites which may be formed according to the present invention. Any number of variations of corner wall composites including among others, the embodiments of curvilinear masonry building units shown in FIGS. 1–8 may be formed according to the invention. Additionally, any other embodiments of curvilinear masonry building units according to the present invention having different sizes, lengths of curvilinear sections and various numbers of planar sections on the front faces of the units may be included in corner wall composites according to the invention.

The various walls, wall composites, chimney composites, or other structures that may be formed according to the present invention may include curvilinear masonry building units which may have a glaze composition applied to either the front face, the back face, both the front and rear faces, and/or the side faces. In some embodiments, as discussed above, glaze composition may form part of the curvilinear portion of the front face as well as the side face(s) or parts thereof.

The present invention also includes methods of applying a glaze composition to form a curvilinear front face on a base masonry building unit. One or more planar portions may also be formed on the front face of the base unit. The invention also includes molds for applying a glaze composition to provide a curvilinear front face for a masonry building unit.

Preferably, a mold according to the invention includes at least a curvilinear portion matching the curvilinear portion that it is desired the front face of the finished curvilinear masonry building unit have. If it is desired that the front face of the curvilinear masonry building unit also include a planar portion, then, preferably, the mold also includes a planar portion intersecting the curvilinear portion or two planar portions on opposite sides of the curvilinear portion in the case where the front face includes two planar portions. A mold according to the invention may also comprise one or more side walls for providing side faces for the glaze portion of a building unit of the invention.

Figure 23:
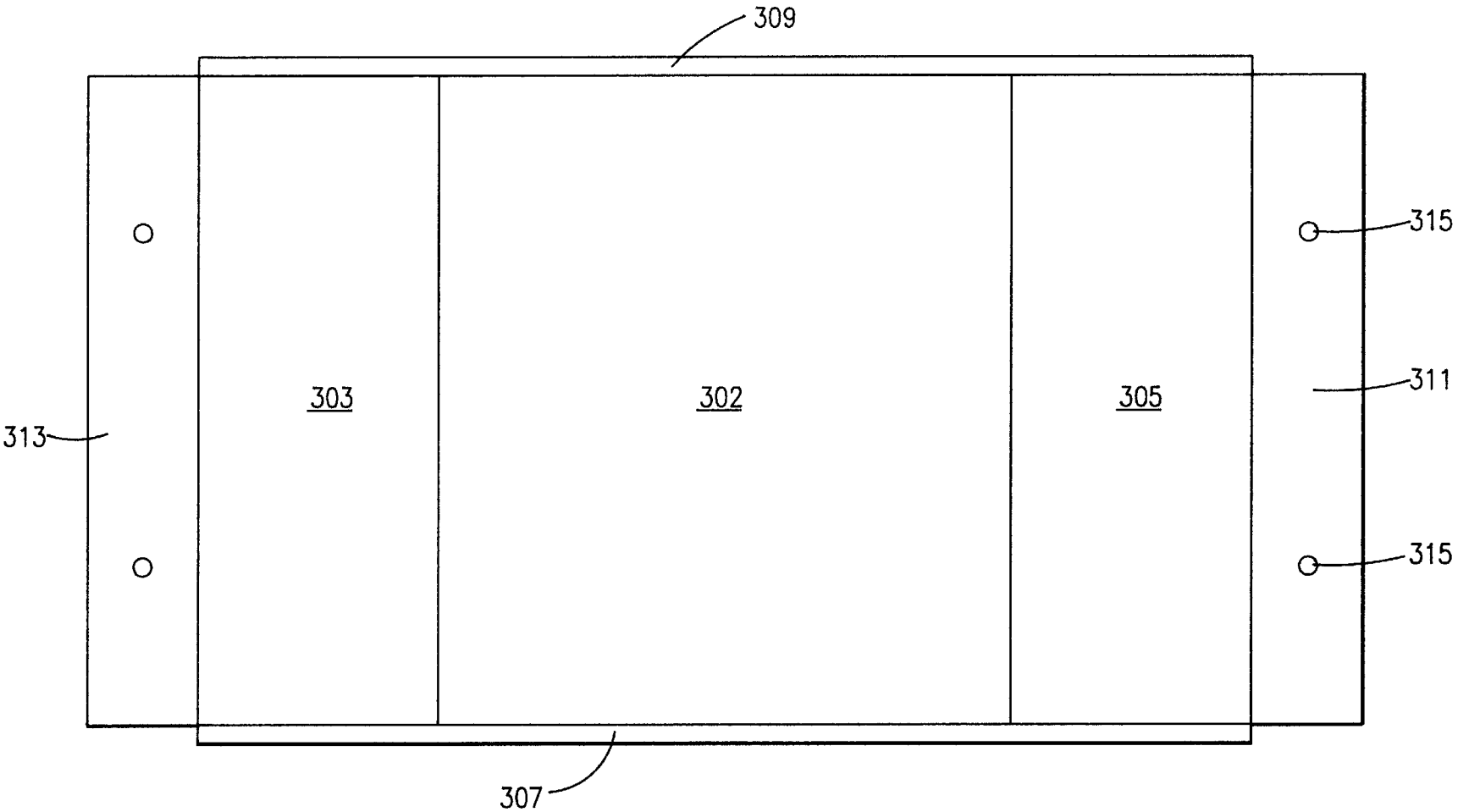
FIG. 23 represents an overhead view of the embodiment of the mold shown in cross-section in FIG. 22.

The invention includes a variety of molds that may be used to apply a glaze composition to a masonry unit according to the invention. FIG. 23 shows a cross-sectional view of one embodiment of a mold 301 which may be used to apply a glaze composition to a base unit, thereby providing the finished unit with a curvilinear surface.

Regardless of the embodiment of the underlying base unit to which a glaze composition is to be applied, as shown in cross-section in FIG. 23, a typical mold 301 for applying a glaze composition according to the present invention preferably includes a curvilinear portion 302. The mold shown in FIG. 23 may be used for forming the embodiment shown in FIG. 3.

The curvilinear portion 302 of the mold 301 preferably intersects with mold end walls 303 and 305. Preferably, the end walls 303 and 305 of the mold 301 abut the side faces of a base unit to which a glaze composition is being applied. The edges of the curvilinear portion 302 of the mold 301 and the edges of the end walls 303 and 305 of the mold 301 preferably intersect side walls 307 and 309 of the mold 301. In preferred embodiments, the side walls 307 and 309 of the mold 301 at least partially abut the top and bottom faces of a block in the mold. The edges of the end walls 303 and 305 of the mold intersect mold flanges 311 and 313. Each mold flange 311 and 313 may have holes 315 formed through it.

Preferably, the side walls are tall enough to ensure that the mold will hold an amount of glaze composition sufficient to form the glaze portion. It may also be desirable to have the side walls tall enough to also accommodate at least a portion of the base unit to ensure proper alignment of the base unit and glaze portions. Furthermore, the side walls may also be tall enough to allow the glaze composition to extend along the side faces of the base unit.

Figure 25:
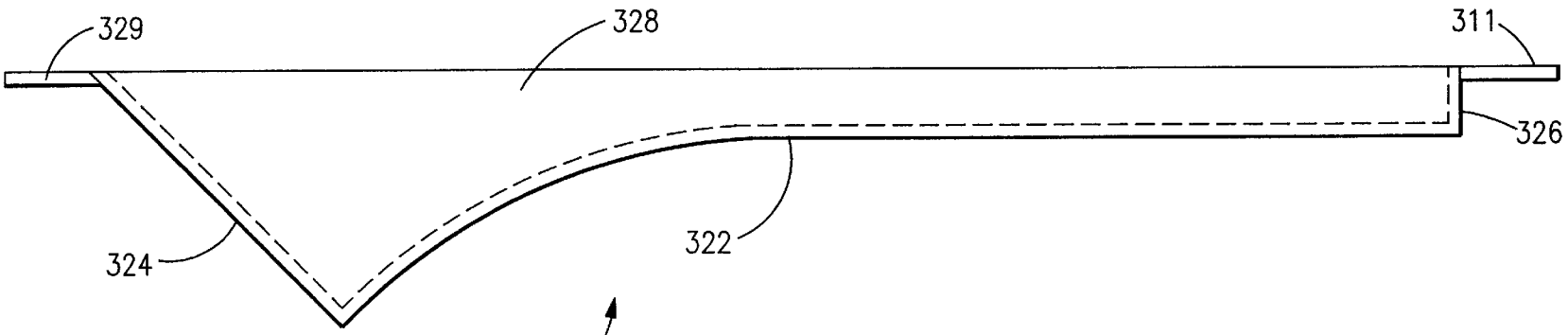
FIG. 25 represents a cross-sectional view of another embodiment of a mold used in applying a glaze composition to a face of a masonry building unit according to a method of the present invention, thereby forming a curvilinear portion.
Figure 24:
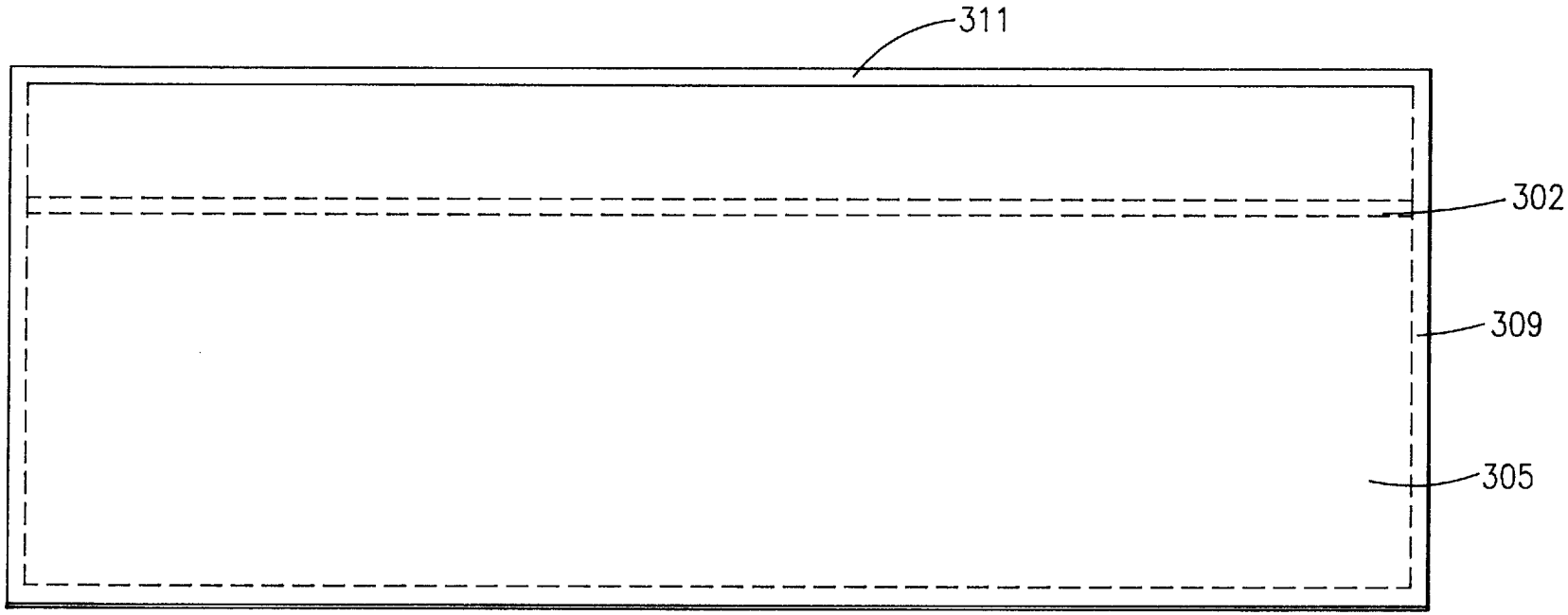
FIG. 24 represents a side view of the embodiment of the mold shown in FIGS. 22 and 23.

FIG. 24 shows an overhead view of the embodiment of the mold shown in cross-section in FIG. 23. FIG. 25 shows an end view of the embodiment of the mold shown in FIGS. 23 and 24.

The embodiment of the mold shown in FIGS. 23–25 may be used to form embodiments of curvilinear masonry building units shown in FIGS. 2 and 6. In a typical embodiment, the mold shown in FIGS. 23–25 preferably includes a curvilinear portion 322 representing about a 45° arc of a circle with a radius of about a 7.75 inch radius. The minimum depth of the mold, from the surface of the curvilinear portion to the top of the side walls, is about 0.75 inch in this embodiment. Also according to this embodiment, the linear distance from the ends of the curvilinear portion, where the curvilinear portion intersects the end walls, is about 11 inches. The distance between where each end wall intersects the flanges in this embodiment is about 16.75 inches.

The side walls of this embodiment preferably are about 7.78 inches apart at the top of the mold, away from where they intersect the curvilinear portion and the side walls, and about 7.73 inches apart at the point where they intersect curvilinear portion and the side walls. Therefore, the side walls preferably are angled outwardly at about a 1° angle. The side walls may be angled at about 45° from a plane passing through the intersections of both side walls with the curvilinear portion. Also, in a typical embodiment, the flanges are about 1 inch wide and the holes in the flanges preferably are centered about 1.25 inch from the sides of the mold.

Each of the above-described dimensions may be altered, depending, at least in part, upon the base unit to which a glaze is being applied, the glaze portion to be created, and the application in which the finished unit is to be used.

Figure 26:
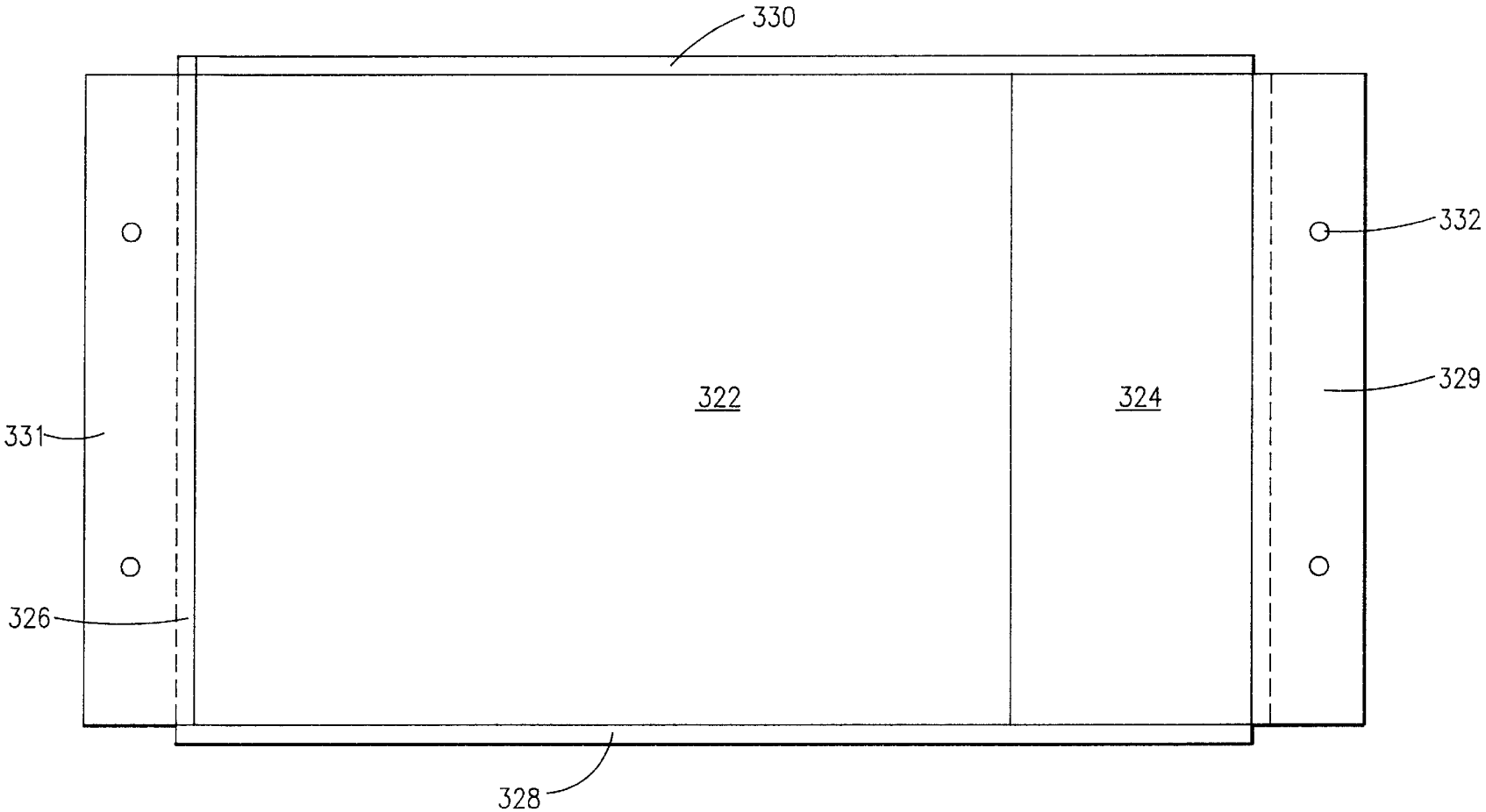
FIG. 26 represents an overhead view of the embodiment of the mold shown in cross-section in FIG. 25.

In embodiments in which the base unit and glaze portion include an extended planar portion. A glaze composition may also be applied to the planar portion. FIG. 26 shows a cross-sectional view of a mold 320 which may be used to form a curvilinear portion from a glaze composition on a base unit.

Mold 320 preferably includes a bottom 322 having planar portion and a curvilinear portion including a curvature similar to that of the face to be created on the base unit. The curvilinear portion of the mold preferably intersects an end wall 324. When the mold is used with a base unit, the end wall 324 acts to contain the glaze composition that will become at least part of the side wall of the finished masonry unit. The other side face of the masonry unit abuts a short end wall 326 which intersects the end of the planar portion of the bottom of the mold. Side walls 328 and 330 of the mold intersect the edges of the bottom 322 of the mold 320 and the edges of the end walls 324 and 326. The mold may also include flanges 329 and 331. The flanges may have holes 332 formed in them, as shown in FIG. 27.

Figure 27:
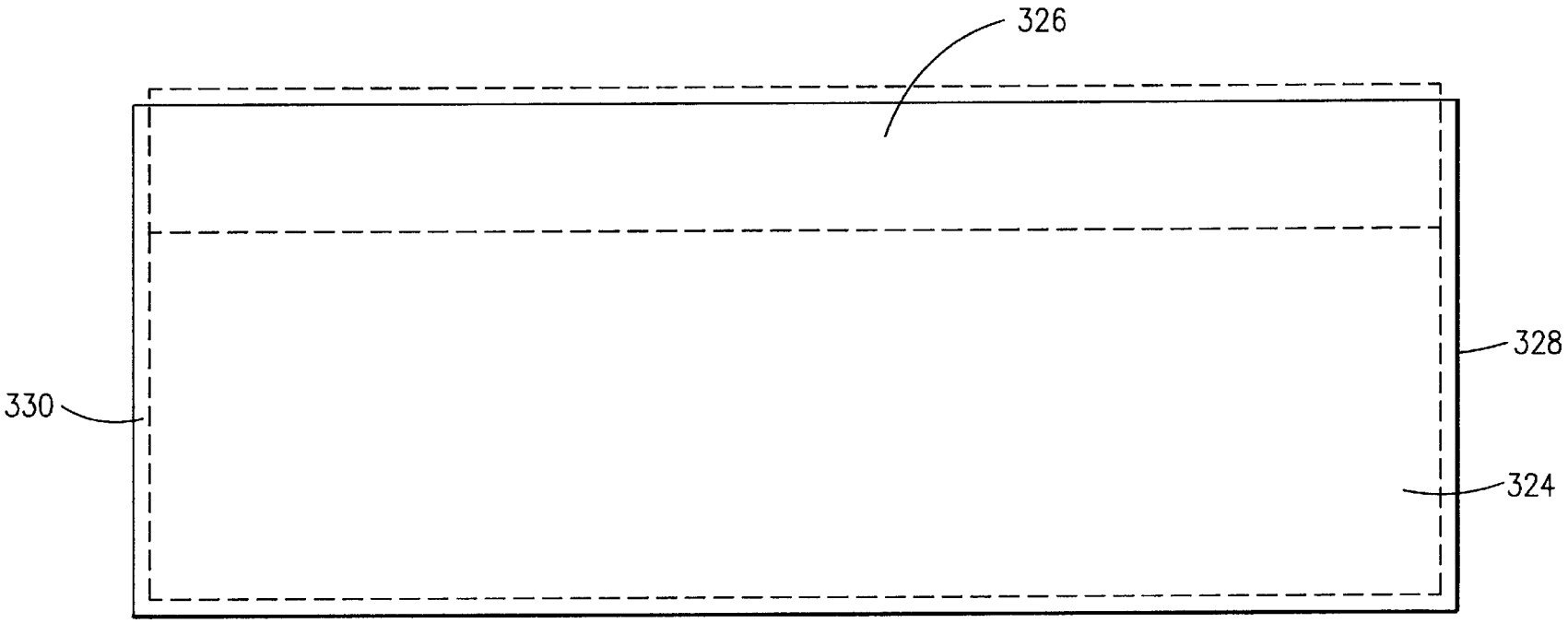
FIG. 27 represents a side view of the embodiment of the mold shown in FIGS. 25 and 26.

In a typical embodiment of the mold shown in FIGS. 26–28, the curvilinear portion represents an arc of about 45° with a 7.75 inch radius. The planar portion in this embodiment is about 7.78 inches long. Also in this embodiment, the end wall preferably joined to the curvilinear portion of the mold preferably is at about a 45° angle in relation to a plane parallel to the planar portion of the mold and passing through the intersection of the end wall and the curvilinear portion. Preferably, in this embodiment, the minimum depth of the mold, from the surface of the planar portion to the top of the side walls, is about 0.75 inch. The minimum depth of the mold of this embodiment, from the intersection of the curvilinear portion with the side wall, may be about 3.0 inches. The distance, along a line parallel to the planar portion of the mold, from the intersection of the end wall and the curvilinear portion to the other end wall is a bout 13.28 inches.

Preferably, the parameters discussed above concerning flanges, holes in the flanges, angle of the side walls, and width of the mold for the mold shown in FIGS. 26–28 are the same for the mold shown in FIGS. 23–25. As stated above, each of the above dimensions may be altered, depending, at least in part, upon the curvilinear masonry building unit to which a glaze is being applied.

According to a method of the present invention for applying a glaze composition to a base masonry building unit of the present invention, the desired glaze composition is applied to the surface of the mold to the desired thickness. The thickness of the glaze depends, at least in part, upon the curvature of the curvilinear surface being created. Typical glaze thicknesses are about one-eight inch up to about four inches. The glaze composition may be larger, depending upon the relationship between the glaze portion and the base unit. Also, typical compositions are in the form of a relatively viscous slurry having a ratio of filler to liquid of about 2.5:1 to about 7:1 and/or typically about 4.0:1 to about 4.5:1.

According to methods of the present invention, a glaze composition may first be added to a mold including a curvilinear portion. The surface of the masonry unit that the curvilinear glaze portion is to be attached to is then placed in contact with the surface of the glaze composition. To form the embodiment shown in FIG. 1, the front face 5 of the base unit would be placed in contact with the glaze composition in the mold. The base unit and/or the mold may then be at least partially forced toward each other to force the base unit at least partially within the glaze composition. The mold and/or base unit may also be vibrated as the base unit and/or mold is forced toward each other. By moving the mold and/or base unit toward each other, the glaze composition may also be at least partially forced to extend beyond the side faces of the base unit. In some instances, the glaze composition may also be forced to extend along the side faces.

In any of the above-described methods, other materials in addition to the glaze composition may also be added to the mold. For instance, aggregate, typically sand, may be placed around the edges of the curvilinear masonry building unit between the inside of the side walls of the mold and the unit. The mold may then be filled to the top with the aggregate. The aggregate typically has a particle size of about 30 to about 150 mesh. The aggregate is wetted by a wicking action from the slurry and the facilitates glazing of the curvilinear masonry building unit.

After this, putty, such as that commercially available, and/or clay, or more commonly, molding clay may be securely placed between the curvilinear masonry building unit and the angle portion of the mold. Whether or not the clay, putty, or any other material listed above is added to the mold, additional glazing composition may then be poured into the cavity, if any, remaining between the base unit and the mold. For instance, space may remain between an inside surface of a portion of the mold and a portion of the base unit opposite that portion of the mold. The putty or clay may help, in conjunction with the base unit, to maintain the slurry in place for glazing the base unit, while filling and going through the cure cycle.

After the glaze and/or other materials have been added to the mold and the base unit inserted into the mold, the glazing composition is then cured. The curing can be carried out at room temperature if desired, depending upon the specific compositions selected. Preferably, it is carried out at an elevated temperature of about 150° F. to about 450° F. and more preferably to about 280° F. to 320° F. Typically, the temperature of the coating is raised to these levels at about 10 to 30 minutes and held there for a sufficient time such as 2 to 5 minutes to complete polymerization of the glaze composition.

After the glaze is properly cured, the curvilinear masonry building unit, now including the base unit and the glaze portion may be removed from the mold.

As discussed above, a glaze composition may also be applied to a surface of a back face or portions thereof of a base unit according to the present invention. If the surface of the back face or portions thereof is substantially planar, a glaze composition may be applied to the surface or surfaces of the back face or faces according to known methods. If the back surface or surfaces include a portion that is curvilinear, the above method or methods described in co-pending U.S. patent application Ser. No. 08/202,254 may be employed.

While the present invention has been described with respect to various preferred aspects thereof, it will be appreciated that the present invention can be implemented by those skilled in the art once aware of the present invention to suit particular requirements. It will be understood that various changes and substitutions may be made within the sphere and scope of the invention as defined in the following claims.

What is claimed is:

1. A building unit, comprising:

a masonry base unit including a planar non-curvilinear front face, two side faces, a back face opposite said front face of said masonry base unit, a top face, and a bottom face; and a glaze composition applied to said planar non-curvilinear front face of said masonry base unit, said glaze composition molded to form a curvilinear portion comprising at least a portion of an inside corner.

2. A building unit according to claim 1, wherein said curvilinear portion intersects said side faces, said top face, and said bottom face of said glaze portion.

3. A building unit according to claim 2, wherein said curvilinear portion comprises an arc up to about 180°.

4. A building unit according to claim 3, wherein said front face of said glaze portion further comprises at least one planar portion that intersects said curvilinear portion and one of said side faces.

5. A building unit according to claim 4, wherein said back face of said base unit comprises at least two planar portions.

6. A building unit according to claim 1, wherein at least one of said side faces of said base unit or said glaze portion comprises at least two planar portions.

7. A building unit according to claim 6, wherein said planar portions of said base unit and/or said glaze portion intersect at an obtuse angle.

8. A building unit according to claim 4, wherein said planar portion of said front face of said glaze portion is about 8 inches or less.

9. A building unit according to claim 1, wherein said front face of said glaze portion comprises at least one planar portion intersecting said curvilinear portion and one of side faces.

10. A building unit according to claim 9, wherein said front face of said glaze portion comprises two planar portions of substantially the same length.

11. A building unit according to claim 1, wherein at least one of said side portions of said base unit and/or said glaze portion comprises at least one cut-out portion.

12. A building unit according to claim 1, wherein said base unit further comprising means for receiving horizontally placed reinforcement rods.

13. A building unit according to claim 1, wherein at least one of said side faces of said base unit and/or said glaze portion comprises a protuberance portion for inserting into a mating cut-out portion of a complementary building unit.

14. A building unit according to claim 1, wherein said front face of said base unit comprises a plurality of planar portions.

15. A wall corner comprising at least one building unit, wherein said building unit comprises a masonry base unit including a planar non-curvilinear front face, two side faces, a back face opposite said front base of said masonry base unit, a top face, and a bottom face; and a glaze composition applied to said planar non-curvilinear front face of said masonry base unit, said glaze composition molded to form a curvilinear portion comprising at least a portion of an inside corner.

16. A wall corner composite comprising at least two building units, wherein each of said building units comprises a masonry base unit including a planar non-curvilinear front face, two side faces, a back face opposite said front face of said masonry base unit, a top face, and a bottom face; and a glaze composition applied to said, planar non-curvilinear front face of said masonry base unit, said glaze composition molded to form a curvilinear portion comprising at least a portion of an inside corner.

17. A chimney composite or portion thereof, comprising:

at least two building units wherein each of said building units comprises a base unit including a planar non-curvilinear front face, two side faces, a back face opposite said front face of said base unit, a top face, and a bottom face; and a glaze composition applied to said planar non-curvilinear front face of said masonry base unit, said glaze composition molded to form a curvilinear portion comprising at least a portion of an inside corner.

* * * * *